US008401434B2

(12) United States Patent
Akaike

(10) Patent No.: US 8,401,434 B2
(45) Date of Patent: Mar. 19, 2013

(54) POWDER STORAGE DEVICE AND IMAGE FORMING APPARATUS USING THE SAME

(75) Inventor: Takashi Akaike, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 443 days.

(21) Appl. No.: 12/540,822

(22) Filed: Aug. 13, 2009

(65) Prior Publication Data

US 2010/0172673 A1 Jul. 8, 2010

(30) Foreign Application Priority Data

Jan. 8, 2009 (JP) ..... P2009-002382

(51) Int. Cl.
*G03G 15/00* (2006.01)
*G03G 15/08* (2006.01)
*G03G 21/12* (2006.01)

(52) U.S. Cl. ..... 399/258; 399/13; 399/120; 399/360

(58) Field of Classification Search ..... 399/13, 399/120, 258
See application file for complete search history.

(56) References Cited

U.S. PATENT DOCUMENTS 4,943,828 A * 7/1990 Manabe et al. ..... 399/113
5,134,443 A * 7/1992 Sumi et al. ..... 399/121
5,589,915 A 12/1996 Hashimoto
5,819,139 A * 10/1998 Harlan et al. ..... 399/110
7,336,916 B2 * 2/2008 Jung et al. ..... 399/111
2003/0228171 A1 * 12/2003 Miyabe et al. ..... 399/111
2007/0147884 A1 * 6/2007 Tanaka ..... 399/111
2008/0286003 A1 * 11/2008 Fukuda et al. ..... 399/119
2009/0080909 A1 * 3/2009 Usui et al. ..... 399/13
2009/0317125 A1 * 12/2009 Tomatsu ..... 399/110

FOREIGN PATENT DOCUMENTS

JP 7-306623 11/1995
JP 2004054097 A * 2/2004
JP 2005-077513 3/2005
JP 2006-039194 2/2006

OTHER PUBLICATIONS

Machine translation of JP 2004-054097.*

* cited by examiner

*Primary Examiner* — Walter L Lindsay, Jr.
*Assistant Examiner* — David Bolduc
(74) *Attorney, Agent, or Firm* — Sughrue Mion, PLLC

(57) ABSTRACT

A powder storage device that stores powder to be supplied or recovered powder, includes: a storage container that is extractably mounted on a container receiver, and in which powder to be supplied or recovered powder is stored; an opening/closing door that opens and closes the container receiver; and an opening/closing restricting mechanism that restricts a closing operation of the opening/closing door, and the opening/closing restricting mechanism includes: a restricting member as defined herein; and a restricted member as defined herein.

13 Claims, 29 Drawing Sheets

WHEN STORAGE CONTAINER IS NOT MOUNTED

WHEN STORAGE CONTAINER IS MOUNTED

POWDER STORAGE DEVICE AND IMAGE FORMING APPARATUS USING THE SAME

CROSS-REFERENCE TO RELATED APPLICATIONS

This application is based on and claims priority under 35 USC 119 from Japanese Patent Application No. 2009-002382 filed on Jan. 8, 2009.

BACKGROUND

Technical Field

The present invention relates to a powder storage device and an image forming apparatus using it.

SUMMARY

According to an aspect of the invention, there is provided a powder storage device that stores powder to be supplied or recovered powder, the powder storage device including: a storage container that is extractably mounted on a container receiver, and in which powder to be supplied or recovered powder is stored; an opening/closing door that opens and closes the container receiver; and an opening/closing restricting mechanism that restricts a closing operation of the opening/closing door, and the opening/closing restricting mechanism including: a restricting member that is disposed on a side of the container receiver, that, when the storage container is not mounted on the container receiver, is located at a predetermined restricting position, and that, when the storage container is mounted on the container receiver, is engaged with the storage container to be retracted from the restricting position to a restriction cancelling position; and a restricted member that is disposed on a side of the opening/closing door, that, when the restricting member is located at the restricting position, is placed at a position where the restricted member interferes with the restricting member so as to restrict the closing operation of the opening/closing door, and that, when the restricting member is located at the restriction cancelling position, is placed at a position where the restricted member does not interfere with the restricting member so as to allow the closing operation of the opening/closing door.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1 . . . container receiver, 2 . . . storage container, 3 . . . opening/closing door, 4 . . . opening/closing restricting mechanism, 5 . . . restricting member, 5*a* . . . recess or hole, 6 . . . restricted member, 6*a* . . . projection, 7 . . . operating member, 8 . . . urging member, 10 . . . constraining mechanism, 11 . . . constraining portion, 12 . . . constrained portion, 13 . . . constraint cancelling mechanism, 14 . . . handle, 15 . . . urging member, 16 . . . image forming device, $P_1$ . . . restricting position, $P_2$ . . . restriction cancelling position

DETAILED DESCRIPTION

Summary of Embodiments

Figure 1:
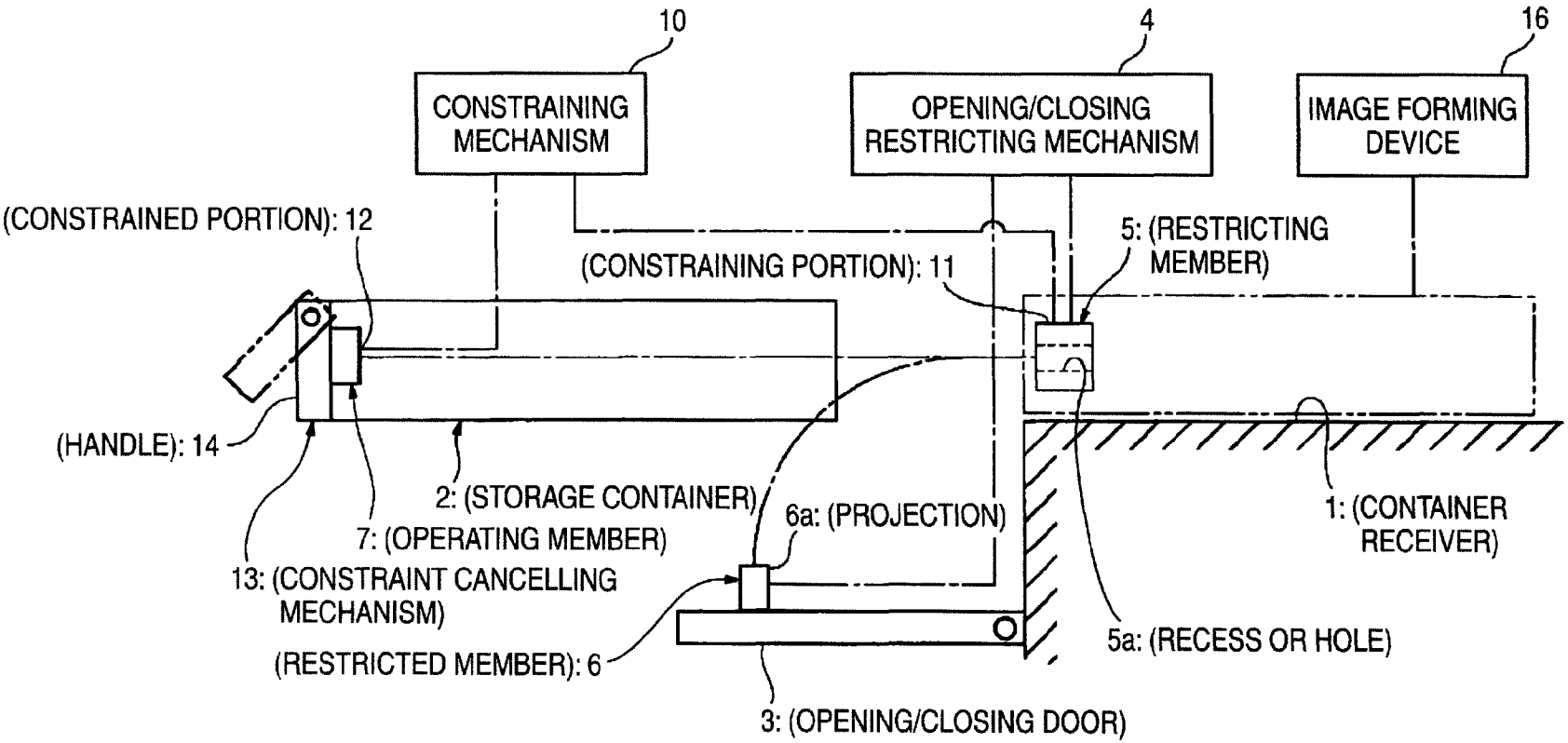
FIG. 1 is a diagram schematically showing an embodiment of a powder storage device to which the invention is applied, and an image forming apparatus using it.

FIG. 1 is a diagram schematically showing an embodiment of a powder storage device to which the invention is applied.

A powder storage device of this type is applied typically as an element of an image forming apparatus which uses an image forming material in the form of powder.

As shown in FIG. 1, an image forming apparatus of this kind includes an image forming device 16 which forms an image by using an image forming material in the form of powder, and a powder storage device which stores the powder to be used in the image forming device 16.

Referring to the figure, the powder storage device stores powder to be supplied or recovered powder, and includes: a storage container 2 which is extractably mounted on a predetermined container receiver 1, and in which powder to be supplied or recovered powder is stored; an opening/closing door 3 which opens and closes the container receiver 1; and an opening/closing restricting mechanism 4 which restricts a closing operation of the opening/closing door 3. The opening/closing restricting mechanism 4 includes: a restricting member 5 which is disposed on the side of the container receiver 1, which, when the storage container is not mounted on the container receiver 1, is located at a predetermined restricting position $P_1$ (see FIGS. 2A and 2B), and which, when the storage container 2 is mounted on the container receiver 1, is engaged with the storage container 2 to be retracted from the restricting position $P_1$ to a restriction cancelling position $P_2$ (see FIGS. 2A and 2B); and a restricted member 6 which is disposed on the side of the opening/closing door 3, which, when the restricting member 5 is located at the restricting position $P_1$, is placed at a position where the member interferes with the restricting member 5 so as to restrict the closing operation of the opening/closing door 3, and which, when the restricting member 5 is located at the restriction cancelling position $P_2$, is placed at a position where the member does not interfere with the restricting member 5 so as to allow the closing operation of the opening/closing door 3.

In such a technical configuration, as a typical mode of the powder, there is an image forming material such as a toner to be used in an image forming apparatus. The powder is not restricted to this.

The storage container 2 may store powder to be supplied or recovered powder.

The opening/closing door 3 is requested to open and close the container receiver 1, and may be an outer door which forms an outer side surface of the chassis of the image forming apparatus, or an inner door which is disposed inside the chassis.

The opening/closing restricting mechanism 4 is requested to restrict the closing operation of the opening/closing door 3, and includes, for example, a mode where it restricts also the opening operation of the opening/closing door 3 in addition to the closing operation of the opening/closing door 3.

The opening/closing restricting mechanism 4 of this kind may be disposed independently from a constraining mechanism 10 which constrains the storage container 2, or may be disposed while sharing a part of elements.

Figure 2A:
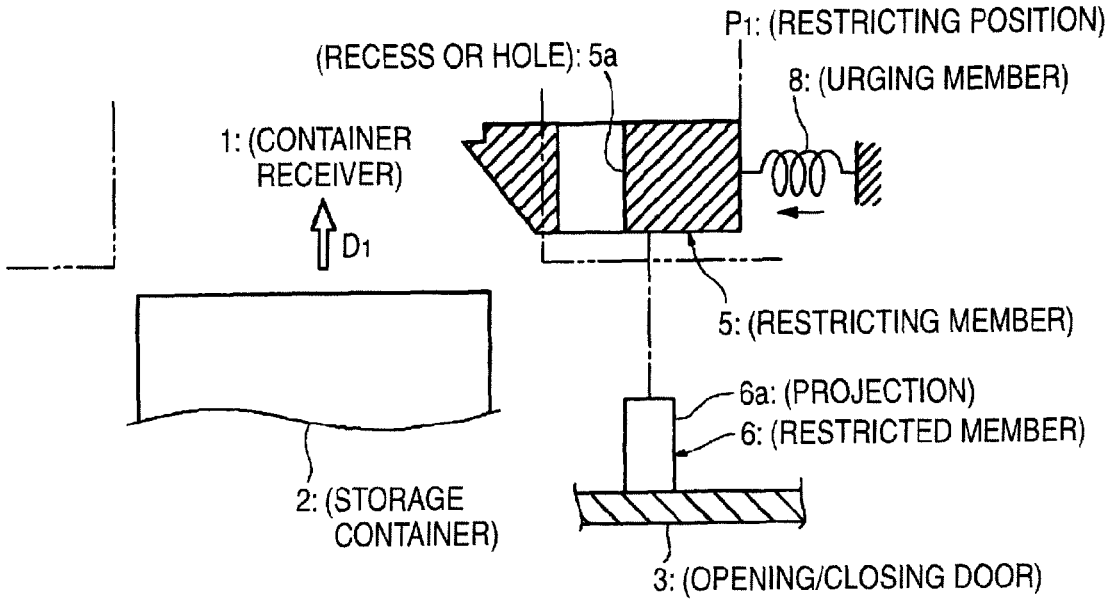
FIG. 2A is a diagram showing a state where a storage container is not mounted in the powder storage device shown in FIG. 1.
Figure 2B:
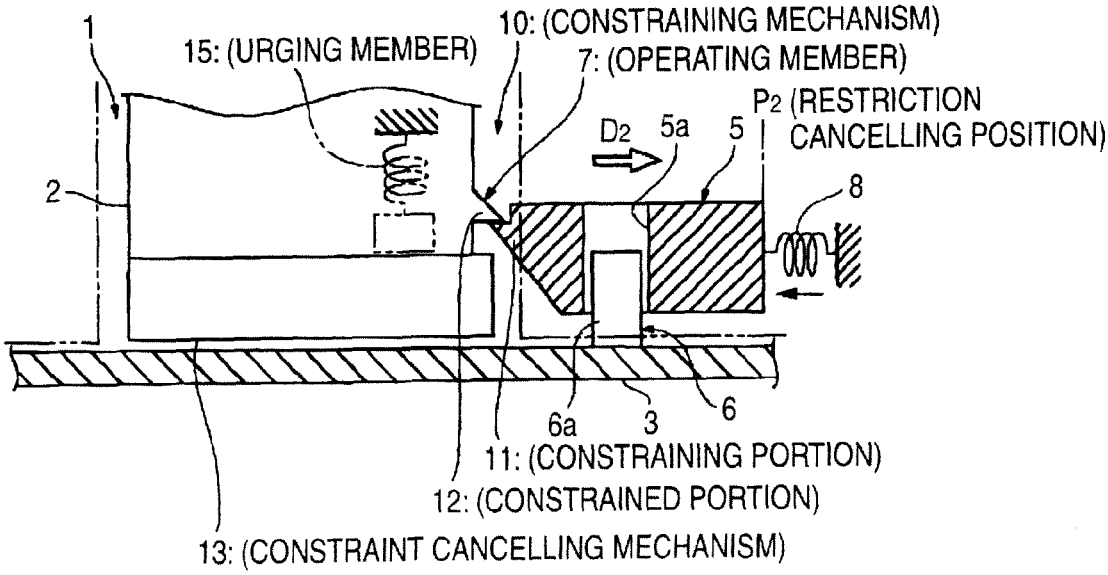
FIG. 2B is a diagram showing a state where the storage container is mounted in the powder storage device.

The restricting member 5 may be adequately configured as far as it is movable between the restricting position $P_1$ and the restriction cancelling position $P_2$ as shown in FIGS. 2A and 2B.

On the other hand, the restricted member 6 is disposed on the side of the opening/closing door 3, and determined whether the member interferes with the restricting member 5 or not, by the position of the restricting member 5 (the restricting position $P_1$ or the restriction cancelling position $P_2$). For example, the restricted member is configured by a projecting member which projects toward the restricting member 5.

As a typical mode of the opening/closing restricting mechanism 4, there is a mode where the mechanism includes an operating member 7 which is disposed on the side of the storage container 2, which, in the process of inserting and mounting the storage container 2 into the container receiver 1, as indicated by the direction of arrow $D_1$ in FIG. 2A, is engaged with the restricting member 5 to move the restricting member 5 located at the restricting position $P_1$ toward the restriction cancelling position $P_2$ (see the direction of arrow $D_2$ in FIG. 2B), and which, when the storage container 2 is mounted on the container receiver 1, causes the restricting member to be retracted to the restriction cancelling position $P_2$.

In this mode, the operating member 7 is disposed on the side of the storage container 2, and, in the process of inserting and mounting the storage container 2 into the container receiver 1, the restricting member 5 is retracted by a change of the positional relationship with the operating member 7. For example, the design may be adequately changed so that an inclined guiding face is disposed in a portion of the restricting member 5 which is to be contacted with the operating member 7, and the restricting member 5 is moved by a change of the position where the operating member 7 and the guiding face are contacted with each other.

From the viewpoint that, when the storage container 2 is dismounted from the container receiver 1, the positional setting of the restricting member 5 is facilitated, preferably, the restricting member 5 is urged toward the restricting position $P_1$ through an urging member 8 as shown in FIGS. 2A and 2B, and, in the process of inserting and mounting the storage container 2 into the container receiver 1, the restricting member is retracted to the restriction cancelling position $P_2$ against the urging force exerted by the urging member 8.

Considering that the restricting position $P_1$ and restriction cancelling position $P_2$ of the restricting member 5 are to be easily set, it is preferable that the restricting member is movable along a direction intersecting with the inserting/extracting direction of the storage container 2.

Considering that the positional relationship between the restricting member 5 and the restricted member 6 is to be easily set, it is preferable that, as shown in FIGS. 1, 2A, and 2B, the restricted member 6 has a projection 6*a* which projects toward the restricting member 5, and the restricting member 5 has a recess (or a hole) 5*a* into which, when the restricting member is located at the restriction cancelling position $P_2$, the projection 6*a* is fitted, at a portion corresponding to the projection 6*a* of the restricted member 6.

From the viewpoint that the configuration of the opening/closing restricting mechanism 4 is simplified, a mode may be employed where the constraining mechanism 10 which, when the storage container 2 is mounted on the container receiver 1, causes the storage container 2 to be constrained to the container receiver 1 is provided, and the constraining mechanism 10 uses the restricting member 5 of the opening/closing restricting mechanism 4, as an element.

As a typical mode of the constraining mechanism 10 of this kind, there is a mode where the mechanism has a constraining portion 11 which is disposed in a part of the restricting member 5, and a constrained portion 12 which is disposed on the side of the storage container 2, and which, when the storage container 2 is mounted on the container receiver 1, is constrained by the constraining portion 11.

From the viewpoint that the constrained state by the constraining mechanism 10 is easily cancelled, a mode is preferable where a constraint cancelling mechanism 13 is provided which is disposed on the side of the storage container 2, and which, when the storage container 2 mounted on the container receiver 1 is to be dismounted, can cancel the constrained state by the constraining mechanism 10.

As a preferred mode of the constraint cancelling mechanism 13, there is a mode where a handle 14 which is swingable in the drawing-out direction is disposed in an end portion in the dismounting direction of the storage container 2 mounted on the container receiver 1, and the constrained state by the constraining mechanism 10 is cancelled by a swing piece (not shown) which, when the handle 14 is swung in the drawing-out direction, is swung together with the handle 14.

As a preferred mode of the structure for mounting the storage container 2, there is a mode where an urging member 15 which urges the storage container 2 in the direction of dismounting from the container receiver 1 is disposed.

The urging member 15 functions in the following manner. In a state where, in the process of inserting and mounting the storage container 2 into the container receiver 1, the storage container 2 has not reached to the mounting position (the mounting state of the storage container is not completed), the storage container 2 is pressed back by the urging force of the urging member 15.

In this state, the restricting member 5 of the opening/closing restricting mechanism 4 does not reach the restriction cancelling position $P_2$, and therefore the opening/closing restricting mechanism 4 can restrict the closing operation of the opening/closing door 3.

As the urging member 15, for example, a spring member which is used as an element of the opening/closing mechanism of the storage container 2, such as a shutter may be employed, and a further spring member may be employed together with or in addition to the spring member. Alternatively, a part of the urging force exerted by the urging member 8 may be used.

Hereinafter, the invention will be described in more detail on the basis of embodiments shown in the accompanying drawings.

Embodiment 1

Whole Configuration of Image Forming Apparatus

Figure 3:
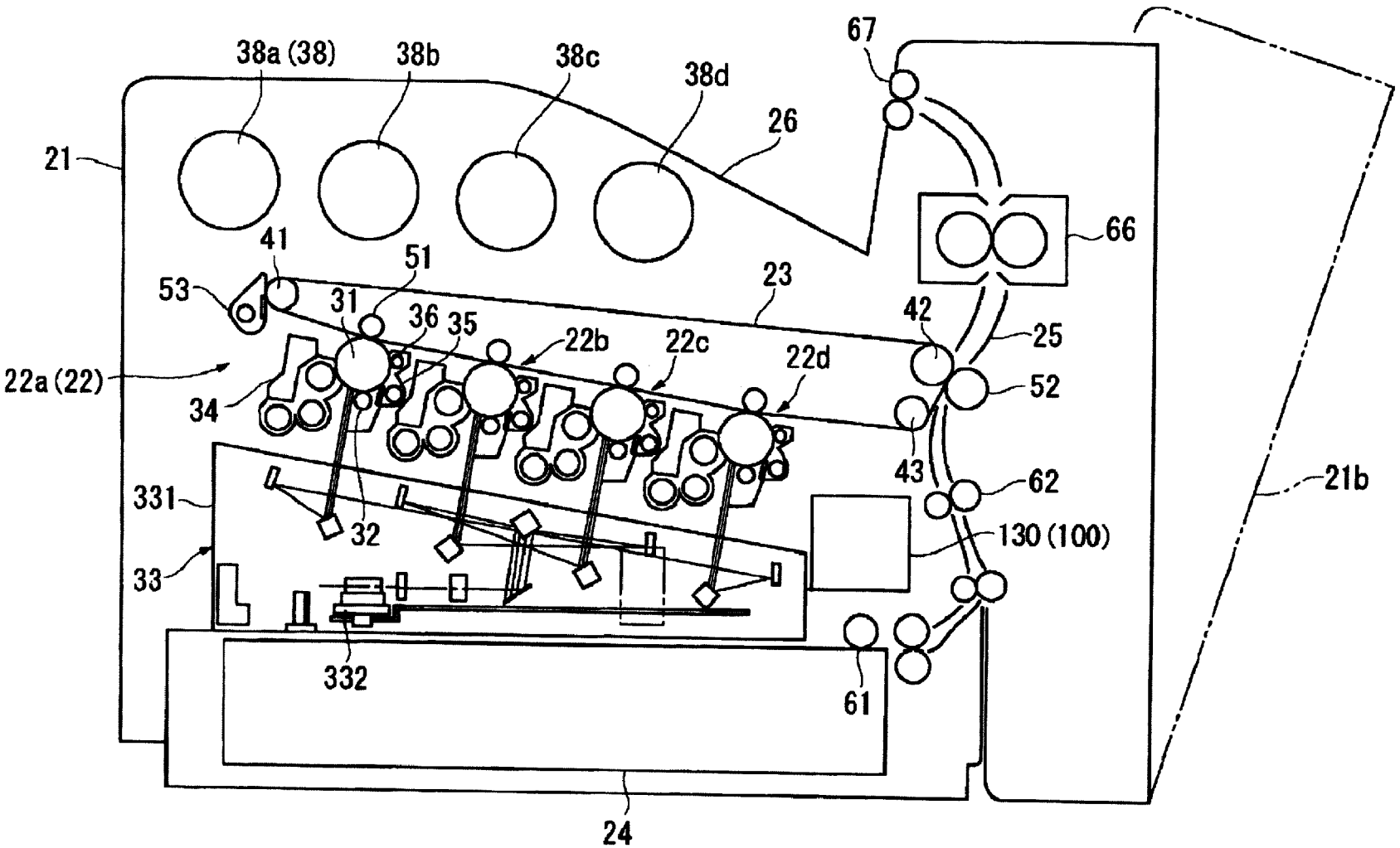
FIG. 3 is a diagram showing the whole configuration of the image forming apparatus of Embodiment 1.

FIG. 3 shows the whole configuration of Embodiment 1 of the image forming apparatus to which the invention is applied.

Referring to the figure, the image forming apparatus is configured so that image forming portions 22 (specifically, 22*a* to 22*d*) for four colors (in the embodiment, black, yellow, magenta, and cyan) are laterally arranged in the chassis of the image forming apparatus (hereinafter, referred to as the apparatus chassis) 21 in positional relationships in which the portions are slightly inclined obliquely upward, an intermediate transfer belt 23 which is circularly driven is disposed above and along the arrangement of the image forming portions 22, a recording material supplying device 24 which stores recording materials in a suppliable manner is disposed in a lower portion of the apparatus chassis 21, a recording material discharge tray 26 into which a recording material that has undergone image formation is discharged and stored is disposed in an upper portion of the apparatus chassis 21, and a recording material from the recording material supplying device 24 is discharged to the recording material discharge tray 26 through a recording material conveying path 25 which extends along the vertical direction.

Figure 4:
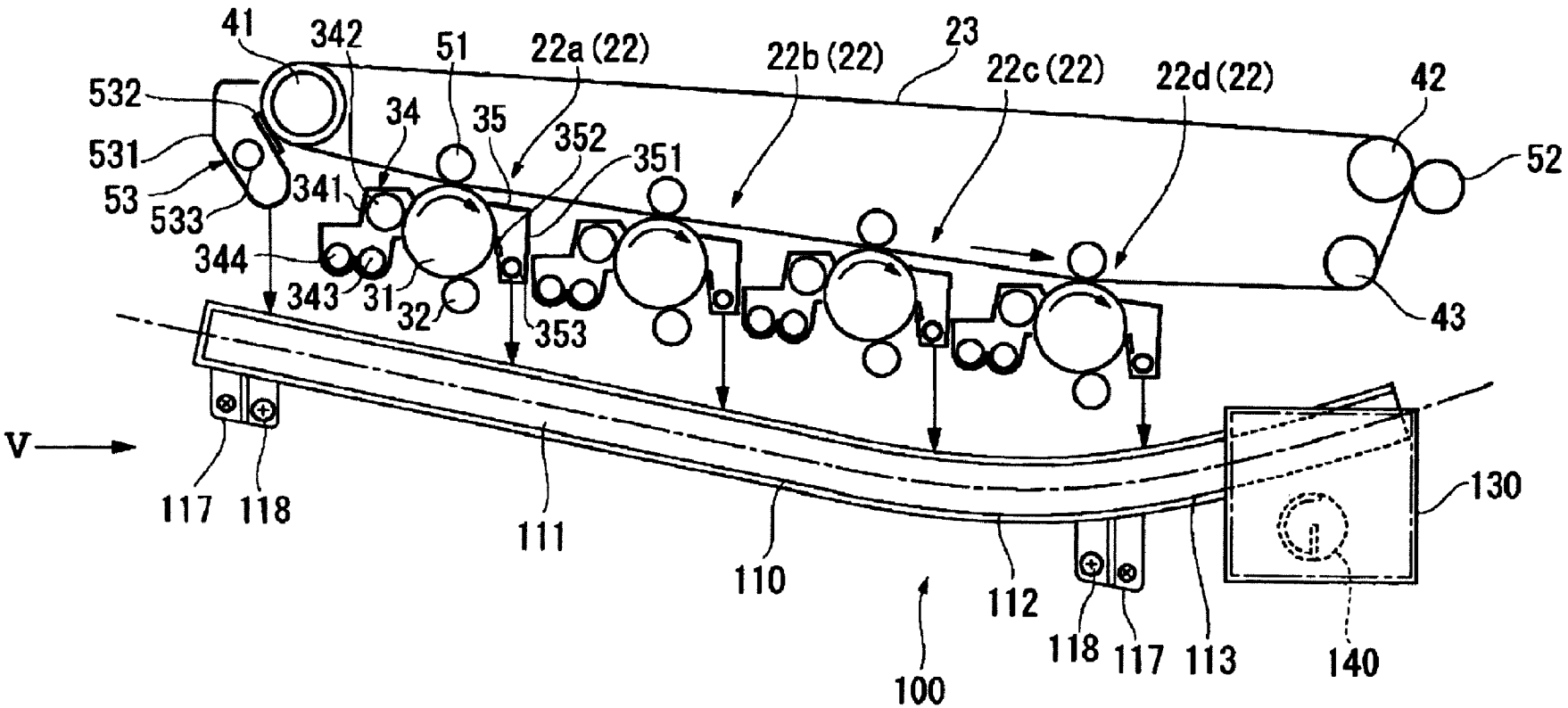
FIG. 4 is a diagram showing a powder recovery device (corresponding to the powder storage device) used in Embodiment 1.

In the embodiment, as shown in FIGS. 3 and 4, in sequence starting from the upstream in the circulating direction of the intermediate transfer belt 23, the image forming portions 22 (22*a* to 22*d*) form toner images of yellow, magenta, cyan, and black (the arrangement is not restricted to this sequence). Each of the image forming portions includes: a photosensitive member 31 which is formed into a drum-like shape or the like; a charging device 32 which previously charges the photosensitive member 31; an exposing device 33 which writes an electrostatic latent image into the photosensitive member 31 that is charged by the charging device 32; a developing device 34 which visualizes the electrostatic latent image on the photosensitive member 31 by means of a toner of a corresponding color; and a cleaning device 35 which cleans a residual toner from the photosensitive member 31.

The exposing device 33 is used commonly in the image forming portions 22, and configured so that, in an exposure case 331, light beams from light sources such as semiconductor lasers (not shown) for respective color components are deflection-scanned by a deflection mirror 332 so that light images are guided to exposure positions on the respective photosensitive members 31, through imaging lenses and mirrors which are not shown.

As shown in FIG. 4, the developing device 34 has a developer container 341 which is opened toward the photosensitive member 31, and which stores a developer containing at least a toner. A developer holding member 342 which can convey the developer toward a developing region located in the position opposed to the photosensitive member 31 is disposed in the opening of the developer container 341. A pair of developer stirring and conveying members 343, 344 which can stir and convey the developer while circulating are disposed on the back of the developer holding member 342 of the developer container 341.

The cleaning device 35 has a cleaning container 351 in which the portion opposed to the photosensitive member 31 is opened. A cleaning member 352 such as a blade is disposed in a portion facing to the opening of the cleaning container 351. A leveling and conveying member 352 which levels residuals (powder) such as a toner that are scraped off by the cleaning member 352 is disposed in the cleaning container 351.

In the embodiment, a discharging device 36 (see FIG. 3, omitted in FIG. 4) which removes residual charges of the photosensitive member 31 is disposed in the periphery of the photosensitive member 31 and upstream from the cleaning device 35 in the rotation direction.

In the embodiment, particularly, the photosensitive member 31 is configured as an image forming assembly (process cartridge) in which the photosensitive member 31 is integrated with the charging device 32, the developing device 34, the cleaning device 35, and the discharging device 36. The image forming assembly is detachably mounted on an assembly receiver of the apparatus chassis 21, and constitutes the main portions of the image forming portion 22 of each color component.

In the embodiment, the image forming assembly includes a photosensitive member assembly into which the photosensitive member 31 is incorporated, and a developing assembly which is swingably coupled to the photosensitive member assembly, and into which the developing device is incorporated.

The intermediate transfer belt 23 is stretched around stretch rolls 41 to 43, and circularly moved by using, for example, the stretch roll 41 as a driving roll. A primary transferring device 51 (for example, a primary transfer roll) is disposed correspondingly with each of the photosensitive members 31, on the rear surface of the intermediate transfer belt 23. When a voltage having a polarity opposite to the charging polarity of the toner is applied to the primary transferring device 51, the toner image on the photosensitive member 31 is electrostatically transferred to the intermediate transfer belt 23.

A secondary transferring device 52 (for example, a secondary transfer roll) is disposed in a portion corresponding to the stretch roll 42 and downstream from the image forming portion 22*d* which is located most downstream in the moving direction of the intermediate transfer belt 23, and secondary-transfers (collectively transfers) the primary transfer images on the intermediate transfer belt 23.

An intermediate cleaning device 53 which cleans a residual toner on the intermediate transfer belt 23 is disposed in a portion of the intermediate transfer belt 23 corresponding to the stretch roll 41 which is downstream from the secondary transfer portion.

As the material of the intermediate transfer belt 23, a material in which an adequate amount of an antistatic agent such as carbon black is contained in a resin material such as polyimide, polycarbonate, polyester, or polypropylene, or various kinds of rubber is used. The intermediate transfer belt is formed so as to have a volume resistivity of $10^6$ to $10^{14}\Omega\cdot$cm.

In a substantially similar manner as the cleaning device 35, also the intermediate cleaning device 53 includes a cleaning container 531, a cleaning member 532, and a leveling and conveying member 533.

In the embodiment, a recording member fed by a feeder 61 of the recording material supplying device 24 is conveyed by an adequate number of conveying rolls (not shown) in the recording material conveying path 25, registered by register rolls 62, and then passed through the secondary transfer portion of the secondary transferring device 52. The unfixed toner images are subjected to heating and pressurizing fixation by a fixing device 66. Thereafter, the recording member is discharged and accommodated in the recording material discharge tray 26 through discharging rolls 67.

In FIG. 3, the reference numeral 38 (38*a* to 38*d*) denotes developer storage containers (toner cartridges) which replenish the developing devices 34 of the image forming portions 22 (22*a* to 22*d*) with a fresh developer (in the embodiment, a toner).

—Powder Recovery Device—

In the embodiment, particularly, powders such as residual toners which are cleaned by the cleaning devices 35 of the image forming portions 22 (22*a* to 22*d*) and the intermediate cleaning device 53 are recovered into a powder recovery device 100 as shown in FIGS. 3 and 4.

Referring to the figures, the powder recovery device 100 includes: a conveying pipe 110 which sequentially conveys powders in the cleaning devices 35 and the intermediate cleaning device 53; and a recovery container (corresponding to the storage container) 130 which is disposed on one end side of the conveying pipe 110, and which recovers the powders conveyed along the conveying pipe 110.

—Conveying Pipe—

In the embodiment, as shown in FIGS. 5 to 7 and 9, the conveying pipe 110 is integrally configured by a resin material (e.g., an ABS resin) which can be formed so as to have, for example, a bent portion, and laterally placed on the back face side of the apparatus chassis 21 and correspondingly with lower positions of back-face end portions of the cleaning devices 35 of the image forming portions 22 (22*a* to 22*d*) and the intermediate cleaning device 53. The conveying pipe 110 may be formed by a material which is bendingly deformable (for example, a vinyl pipe).

The conveying pipe 110 has a linear portion 111 which corresponds to the intermediate cleaning device 53 and the cleaning devices of the image forming portions 22 (22*a* to 22*c*), and which is slightly inclined obliquely downward with respect to a horizontal posture, a bent portion 112 which is curvedly bent with respect to the linear portion 111 is formed in a portion corresponding to the cleaning device 35 of the image forming portion 22*d*, and a linear portion 113 which is slightly inclined obliquely upward is formed through the bent portion 112, so that the pipe has a flat U-like shape in which the lower side is convex.

Connecting portions 114 which correspond to the intermediate cleaning device 53 and the cleaning devices 35 of the image forming portions 22 (22*a* to 22*d*) are disposed in the upper wall of the conveying pipe 110. A powder supply port 115 is opened in each of the connecting portions 114, and a volumetric feeding mechanism 116 which can feed a constant quantity of powder is disposed in each of the powder supply ports 115.

Attaching pieces 117 are disposed in a part of the conveying pipe 110. The conveying pipe 110 is attached by fixing pieces 118 to a rear frame which is a part of the apparatus chassis 21, through the attaching pieces 117.

A discharge port 119 communicating with the recovery container 130 is disposed in a part of the lower wall of the linear portion 111 of the conveying pipe 110. A shutter 120 which is openable against the urging force of a spring that is not shown is disposed in a portion corresponding to the discharge port 119.

—Conveying Member—

Figure 6A:
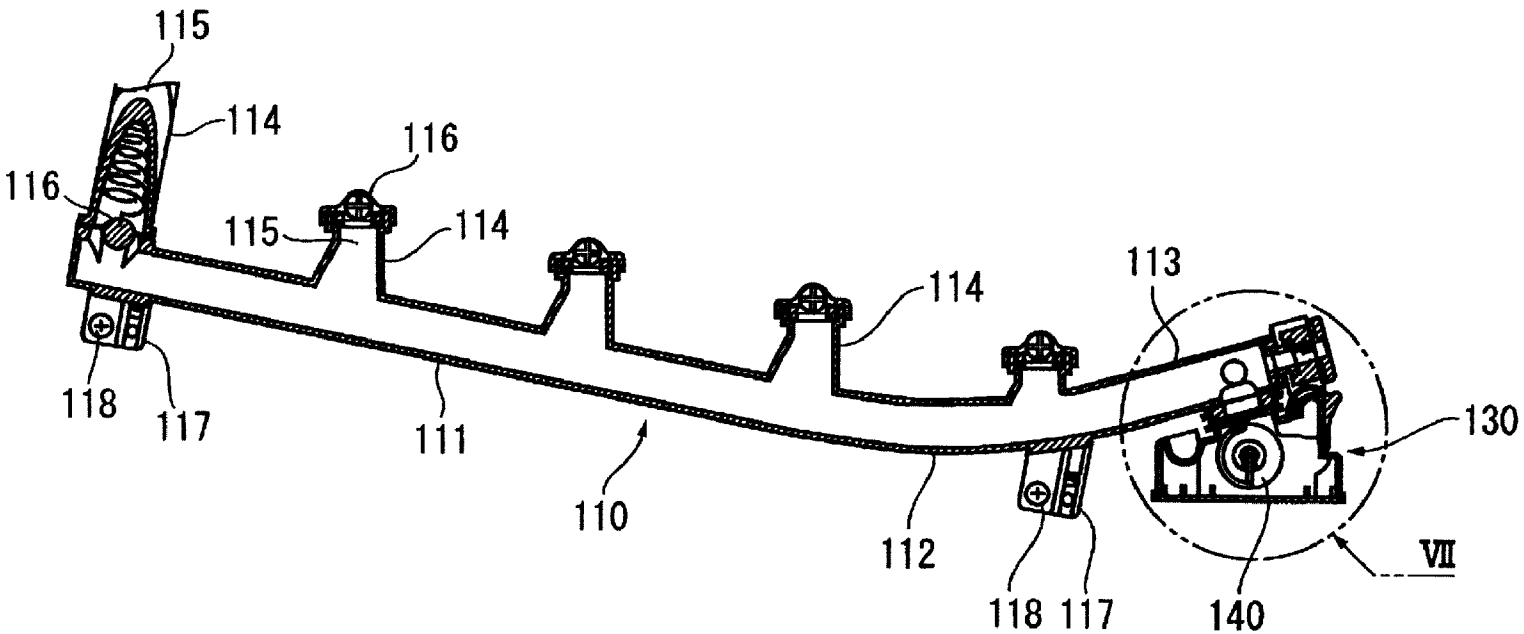
FIG. 6A is a view looking in direction VI-VI in FIG. 5.
Figure 6B:
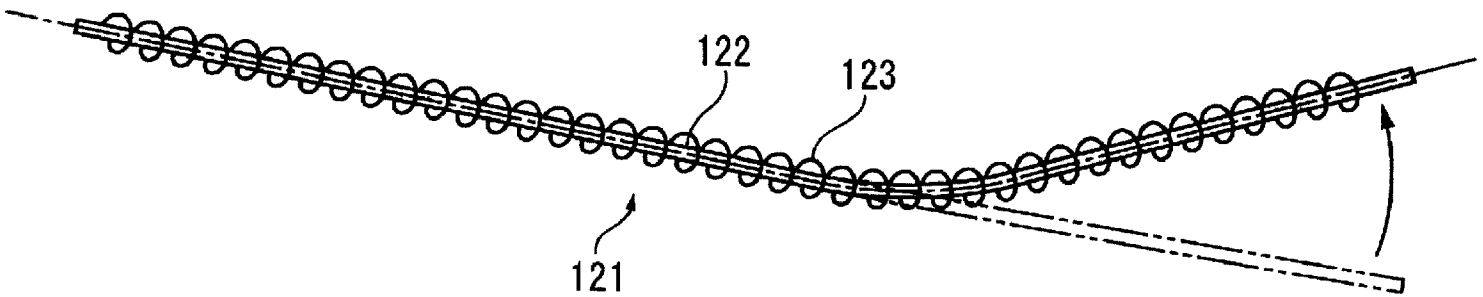
FIG. 6B is a diagram showing an example of a conveying member in a conveying pipe.

As shown in FIG. 6B, a conveying member 121 is disposed in the conveying pipe 110.

In the embodiment, the conveying member 121 is integrally formed by a resin material which is bendingly deformable (for example, POM, Nylon (registered trademark), PE, or PET), and has a rotation shaft 122 which linearly extends, and a vane portion 123 which is spirally formed in the periphery of the rotation shaft 122. An end portion of the rotation shaft 122 is supported in a cantilevered manner by a bearing member 124 (see FIG. 7) disposed in one end portion of the conveying pipe 110. The conveying member is disposed in the conveying pipe 110 in a state where the conveying member is elastically bent and deformed along the bent shape of the conveying pipe 110.

—Recovery Container—

Figure 5:
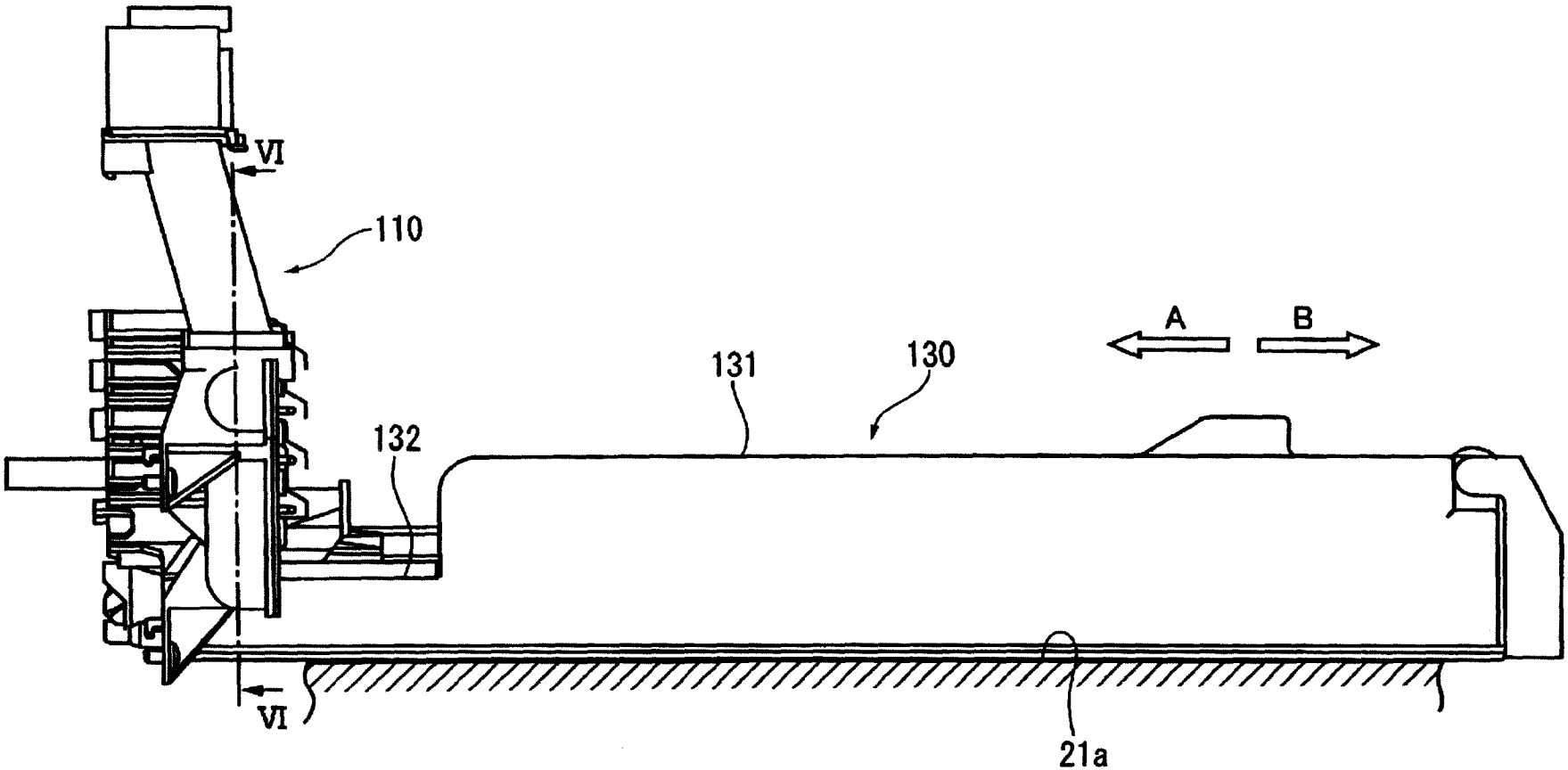
FIG. 5 is a view looking in direction V in FIG. 4.
Figure 7:
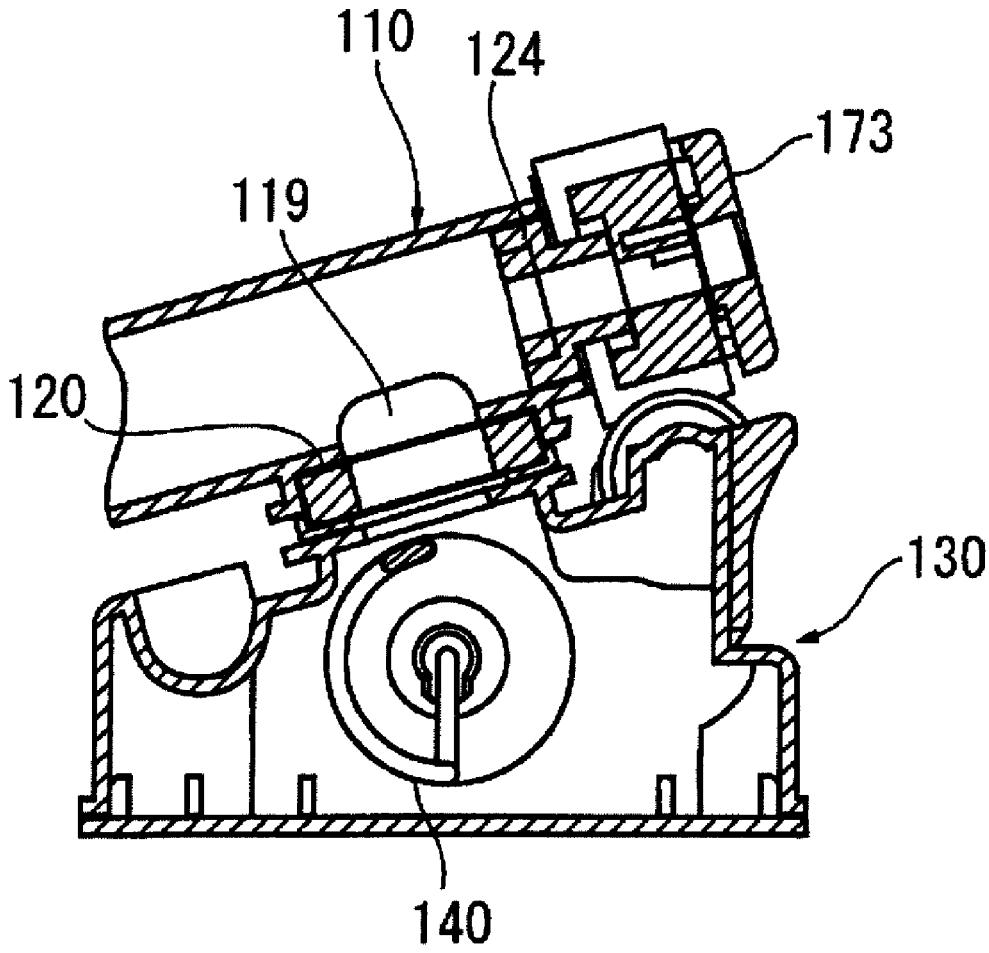
FIG. 7 is an enlarged partial view of portion VII in FIG. 6A.
Figure 8A:
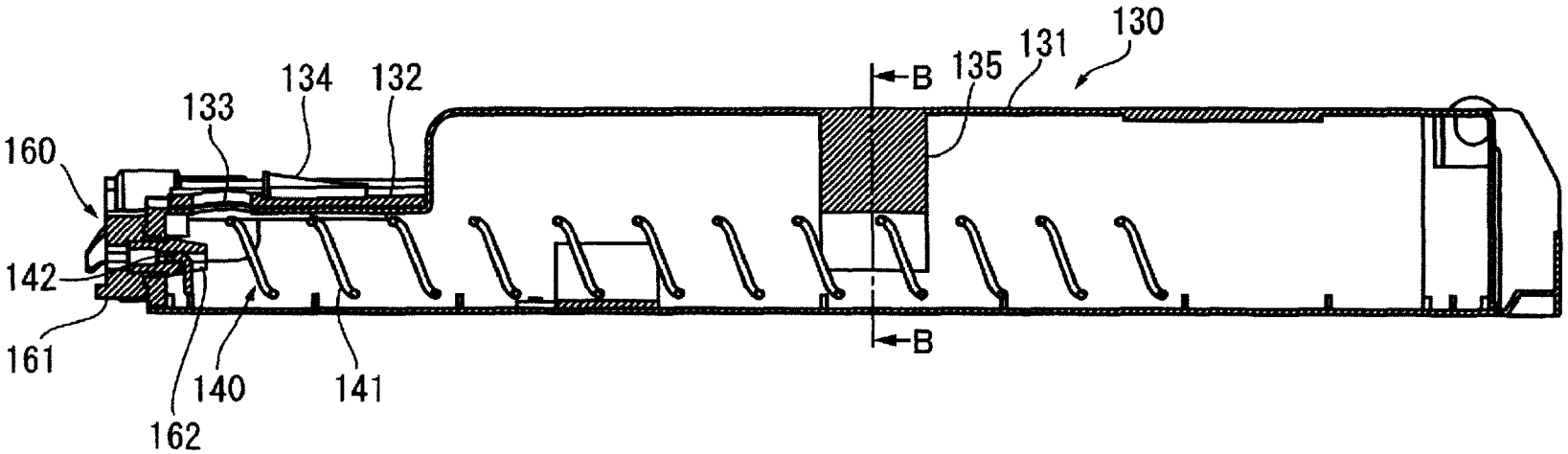
FIG. 8A is a longitudinal sectional view taken along the longitudinal direction of a recovery container (corresponding to the storage container)
Figure 8B:
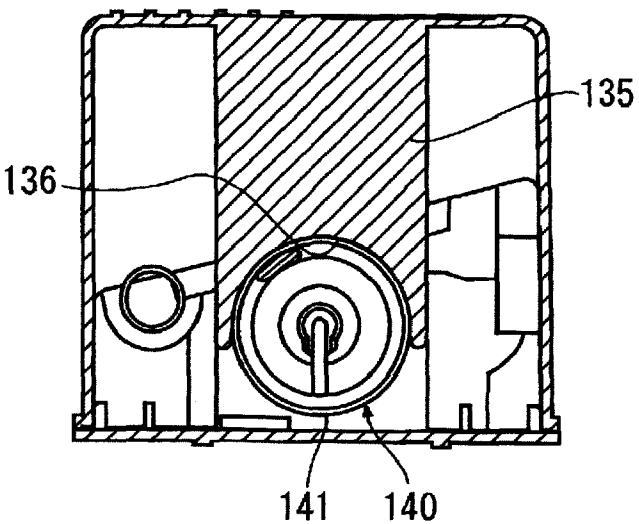
FIG. 8B is a sectional view taken along line B-B in FIG. 8A.

In the embodiment, as shown in FIGS. 5, 7, and 8, the recovery container 130 is disposed intersectingly with the conveying pipe 110 so as to be perpendicular thereto. When a front opening/closing door (not shown) of the apparatus chassis 21 is opened, the recovery container is inserted and mounted on a container receiver 21*a* in direction A (see FIG. 5) which is directed from the front side of the apparatus chassis 21 toward the back surface side, or conversely drawn out and dismounted in direction B (see FIG. 5) which is directed from the back surface side of the apparatus chassis 21 toward the front side.

The recovery container 130 is integrally configured by a resin material such as an ABS resin, and has a hollow box-like container body 131 for recovering powder.

A recessed step portion 132 is formed in a portion of the container body 131 which intersects with the conveying pipe 110, and the intersecting portion of the conveying pipe 110 is put on the step portion 132.

A recovery port 133 is disposed on the step portion 132 of the recovery container 130. Also in the recovery port 133, a shutter 134 which is openable against the urging force of a spring that is not shown is disposed. When the recovery container 130 is mounted on the container receiver 21*a*, the shutter 134 is engaged with the shutter 120 of the conveying pipe 110. At the timing when the discharge port 119 of the conveying pipe 110 coincides with the recovery port 133 of the recovery container 130, the recovery port 133 is opened, and the shutter 120 is opened (see FIGS. 7 and 11).

—Conveying Member—

As shown in FIGS. 7 and 8, the recovery container 130 has a conveying member 140 which uniformly levels powder recovered into the container body 131.

The conveying member 140 is configured by a spirally linear member 141 which extends in the longitudinal direction of the container body 131. One end of the spirally linear member 141 is configured as a rotation shaft 142. The one-end rotation shaft 142 of the spirally linear member 141 is hooked and supported by a hook claw 162 of a coupling member 161 which is rotatably disposed in one longitudinal end of the container body 131.

The recovery container 130 has a pressing wall 135 which downward extends from the upper wall, in the vicinity of the longitudinal middle of the container body 131. A cutaway 136 which extends over an upper half of the spirally linear member 141, and which has a semicircular section shape is formed in a lower portion of the pressing wall 135 so that the disposition position of the spirally linear member 141 is regulated.

—Driving System of Powder Recovery Device—

Figure 9:
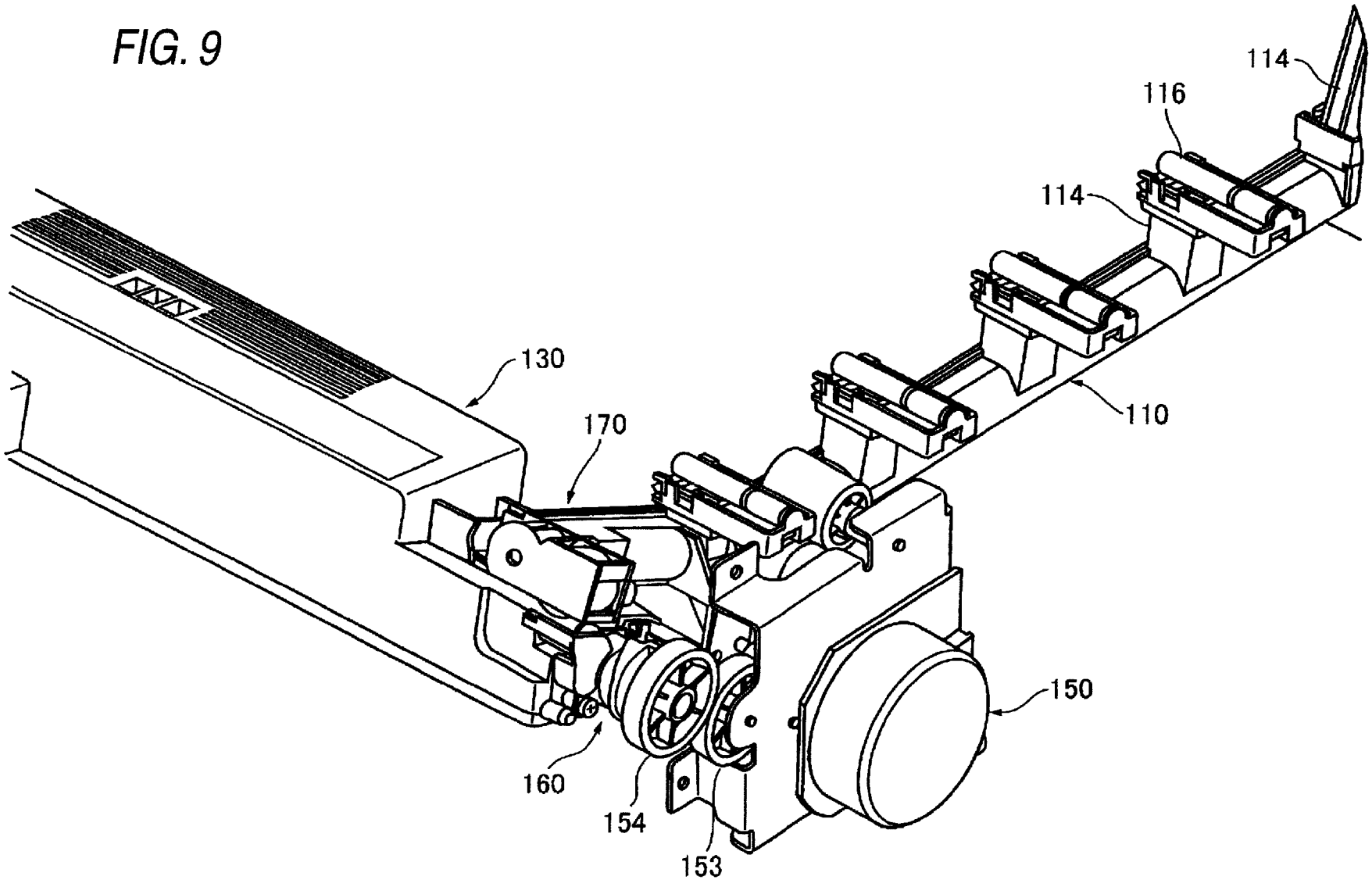
FIG. 9 is a perspective view showing in detail main portions of the powder recovery device used in Embodiment 1.
Figure 10:
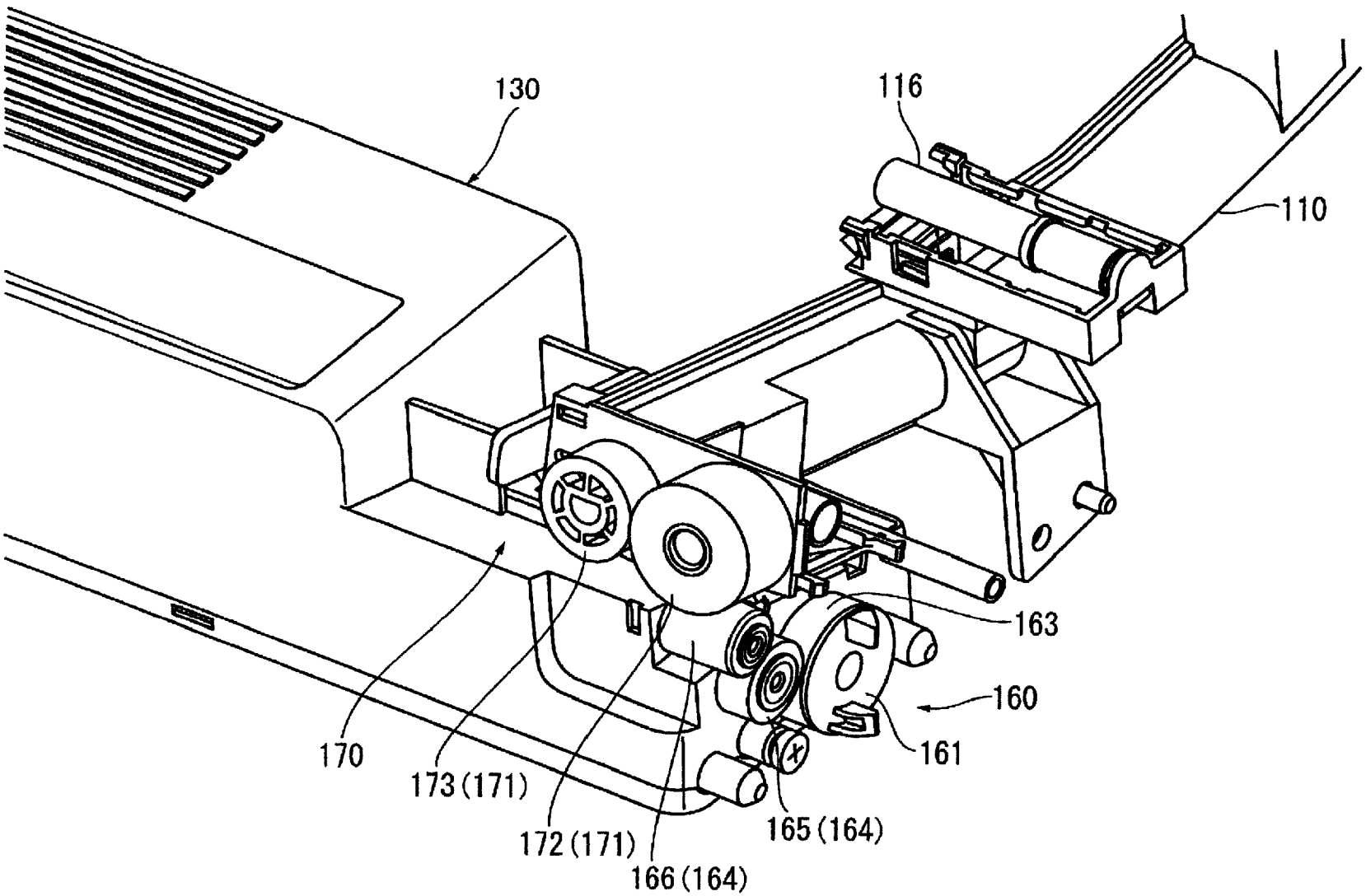
FIG. 10 is a view showing in detail a recovery driving mechanism for the recovery container used in Embodiment 1, and a conveyance driving mechanism for the conveying pipe.
Figure 11:
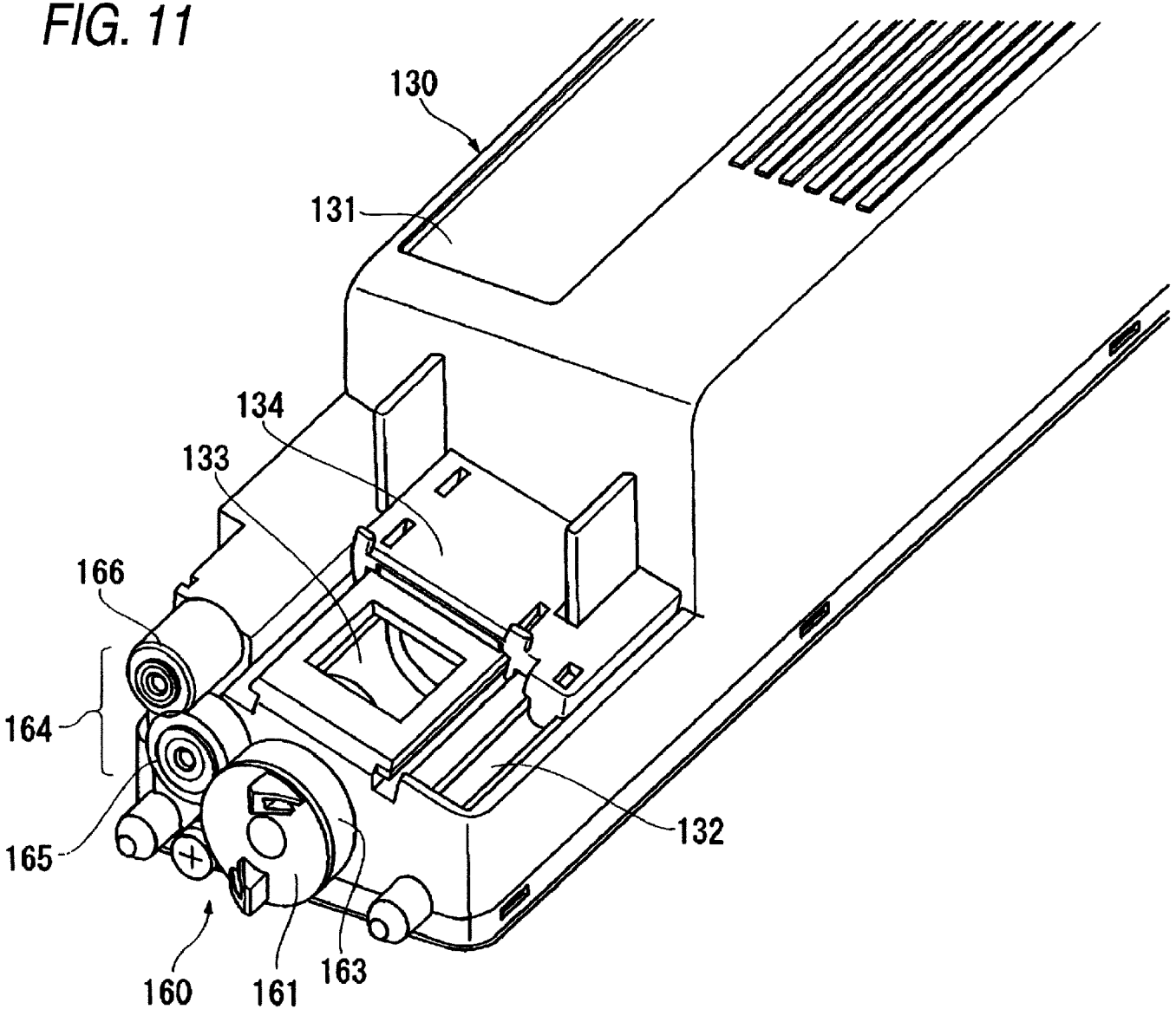
FIG. 11 is a view showing in detail a portion in which the recovery container used in Embodiment 1 is connected to the conveying pipe.

As shown in FIGS. 9 to 11, the driving system of the powder recovery device 100 includes: a driving motor 150 which is fixed to the rear frame of the apparatus chassis 21; a recovery driving mechanism 160 in which the conveying member 140 of the recovery container 130 is driven by a driving force exerted by the driving motor 150; and a conveyance driving mechanism 170 which, when the recovery container 130 is mounted on the container receiver 21*a*, is engaged with the recovery driving mechanism 160 to drive the conveying member 121 in the conveying pipe 110 through the recovery driving mechanism 160.

<Driving Motor>

In the embodiment, as shown in FIGS. 8 and 9, the driving force of the driving motor 150 is used in, for example, the developing device 34 (see FIG. 3) of that image forming portion 22*d*, and also in the conveying member 140 of the recovery container 130. Specifically, a driving gear (not shown) is disposed coaxially with the shaft of the driving motor 150, a first driving transmission gear train (not shown) which extends toward the developing device 34 is disposed in the driving gear, a second driving transmission gear train 153 which extends toward a coupling member 161 of the conveying member 140 of the recovery container 130 is disposed, and a coupled member 154 which can be coupled with the coupling member 161 meshes with the final gear of the second driving transmission gear train 153.

<Recovery Driving Mechanism>

In the embodiment, as shown in FIGS. 8, 10, and 11, the recovery driving mechanism 160 includes: the coupling member 161 and hook claw 162 which are coupled to the rotation shaft 142 of the conveying member 140 in the recovery container 130; a gear portion 163 which is disposed in the periphery of the coupling member 161; and a driving transmission gear train 164 (specifically, driving transmission gears 165, 166) which meshes with the gear portion 163 to transmit the driving force.

In the embodiment, when the coupling member 161 is coupled to the coupled member 154 on the side of the driving motor 150, the recovery driving mechanism 160 drives the conveying member 140 of the recovery container 130.

<Conveyance Driving Mechanism>

In the embodiment, as shown in FIG. 10, the conveyance driving mechanism 170 has a driving transmission gear train 171 configured by a driving transmission gear 173 which is disposed coaxially with the rotation shaft 122 of the conveying member 121 of the conveying pipe 110, and a driving transmission gear 172 which meshes with the driving transmission gear 173. When the recovery container 130 is mounted on the container receiver 21*a* (see FIG. 5), the final gear 166 of the driving transmission gear train 164 of the recovery driving mechanism 160 is engaged with the driving transmission gear 172.

In the embodiment, the driving transmission gear train 171 of the conveyance driving mechanism 170 has driving transmission gears each of which is configured by a helical gear, and also the driving transmission gear train 164 of the recovery driving mechanism 160 has driving transmission gears each of which is configured by a helical gear.

When the recovery container 130 is dismounted from the container receiver 21*a*, the engagement between the recovery driving mechanism 160 and the conveyance driving mechanism 170 is cancelled.

—Powder Storage Device—

In the embodiment, the recovery container 130 is inserted and mounted on the container receiver 21*a* of the apparatus chassis 21. The recovery container 130 is configured as an element of a powder storage device 200 which stores the recovered powder.

In the embodiment, as shown in FIGS. 12 to 15, the powder storage device 200 includes: the recovery container 130 which is inserted and mounted on the container receiver 21*a*; an opening/closing door 220 which opens or closes the container receiver 21*a*; an opening/closing restricting mechanism 230 which restricts the closing operation of the opening/closing door 220; a locking mechanism 260 which, when the recovery container 130 is mounted on the container receiver 21*a*, constrains the recovery container 130 to the container receiver 21*a*; and a lock cancelling mechanism 270 which is disposed on the side of the recovery container 130, and which, when the recovery container 130 mounted on the container receiver 21*a* is to be dismounted, cancels the constrained state by the locking mechanism 260.

—Container Receiver and Opening/Closing Door—

Figure 12:
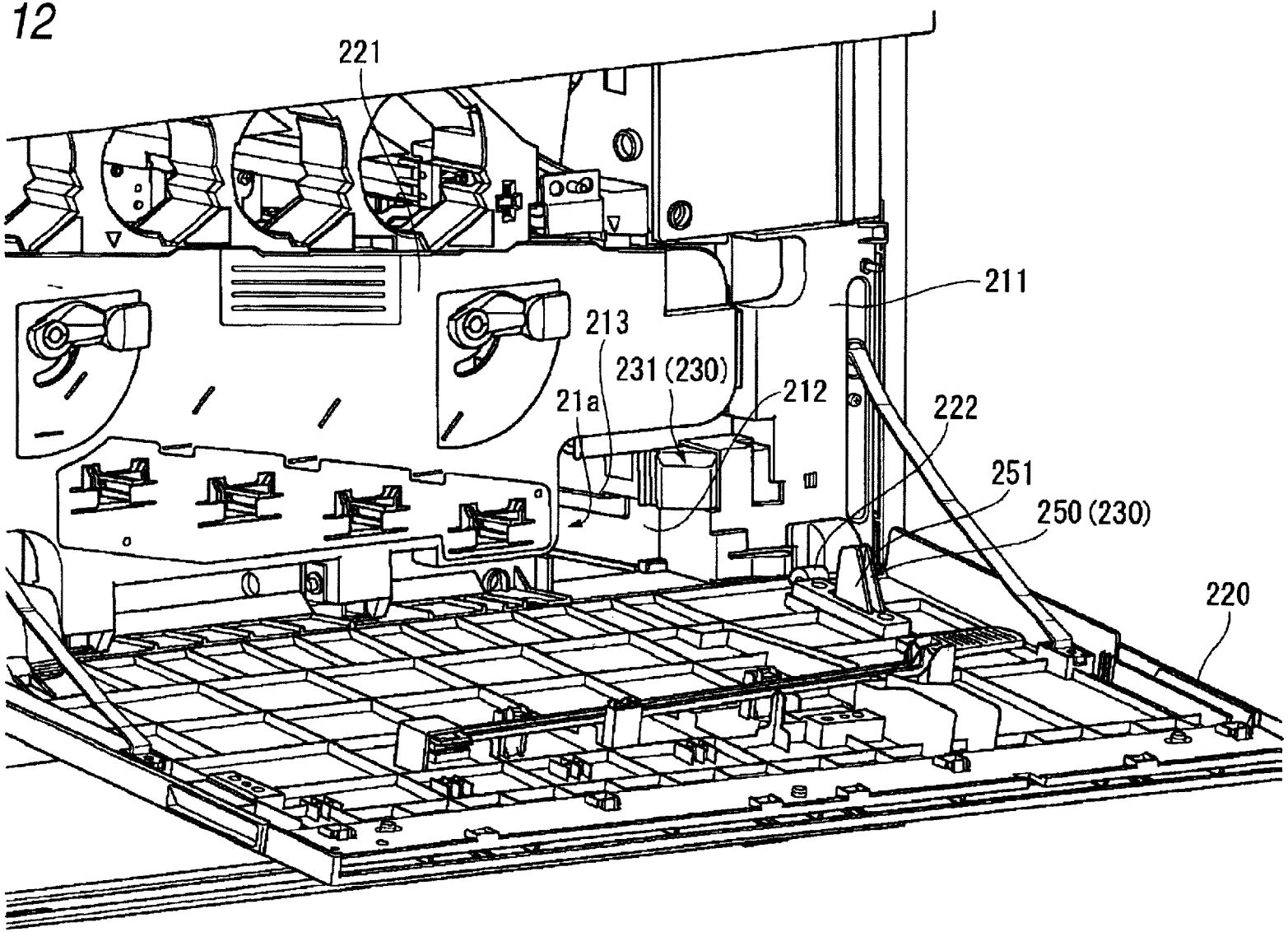
FIG. 12 is a view showing a state of the powder recovery device to which the recovery container used in Embodiment 1 is not mounted.
Figure 13:
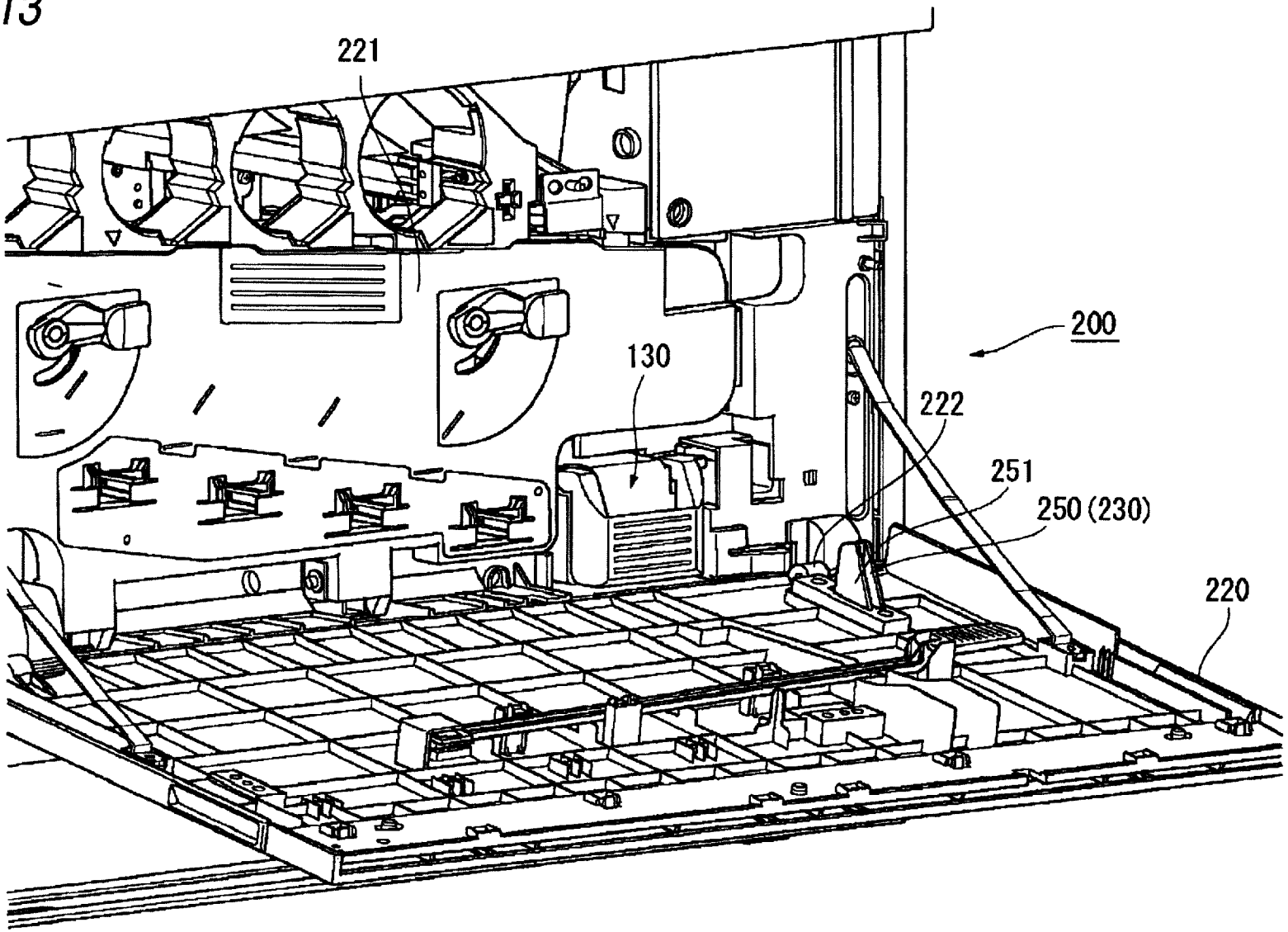
FIG. 13 is a view showing a state of the powder recovery device to which the recovery container used in Embodiment 1 is mounted.
Figure 14:
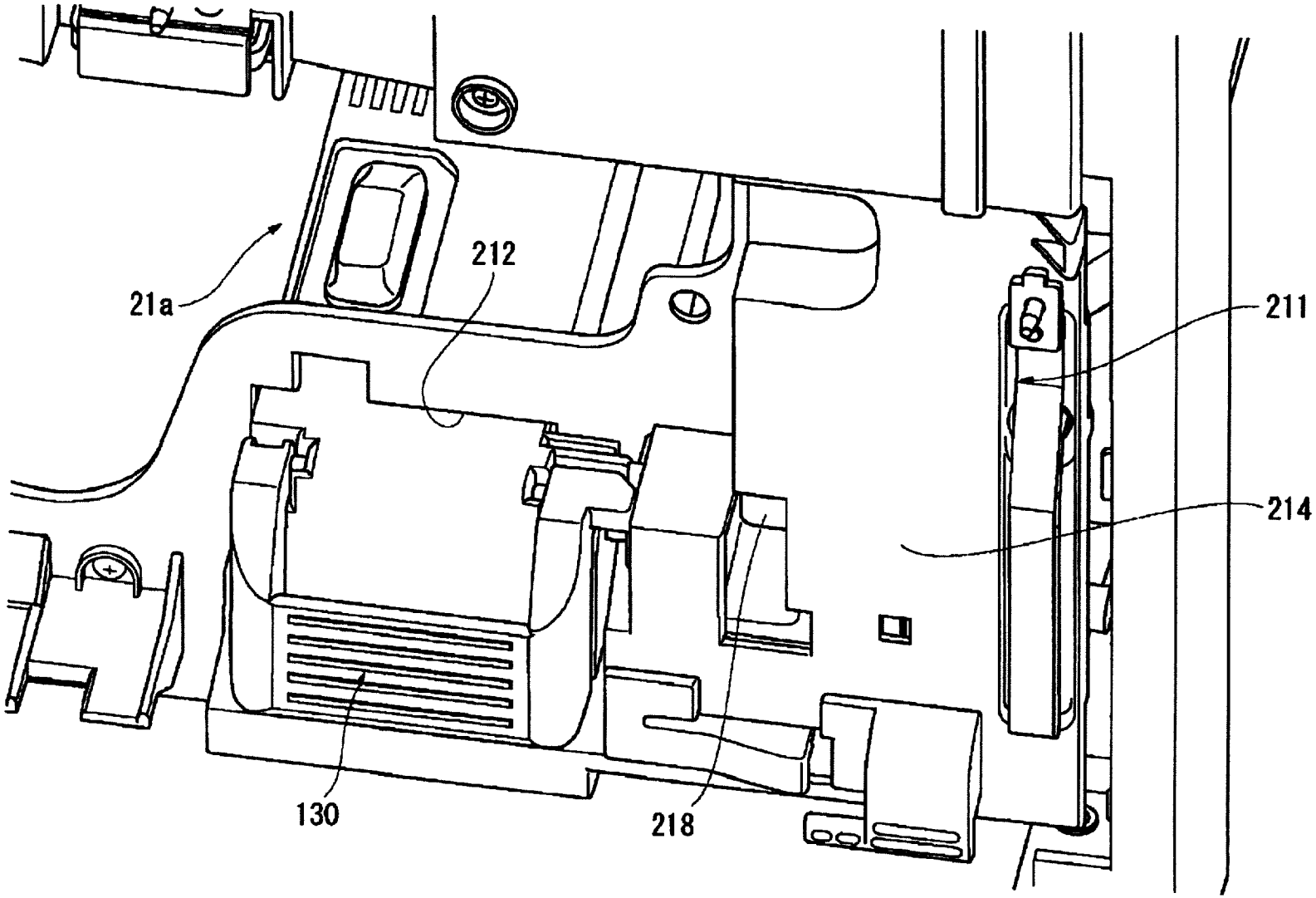
FIG. 14 is a view showing main portions of FIG. 13.

In the embodiment, as shown in FIG. 12, the container receiver 21*a* is configured so that a container insertion port 212 into which the recovery container 130 can be inserted is opened in a front frame 211 of the apparatus chassis 21, and, in the apparatus chassis 21, the recovery container 130 is slidably guided and supported along a guide rail 213 which extends from the front side toward the back surface side.

The opening/closing door 220 is supported so as to be swingable about a swing shaft 222 with respect to a region corresponding to the container insertion port 212 which is opened in the front frame 211 of the apparatus chassis 21, and a pressing lid 221 which presses the image forming assembly (process cartridge) from the front side.

—Opening/Closing Restricting Mechanism—

In the embodiment, the opening/closing restricting mechanism 230 includes: a restricting member 231 which is disposed on the side of the container insertion port 212 of the container receiver 21*a*, which, when the recovery container 130 is not mounted on the container receiver 21*a*, is located at the predetermined restricting position $P_1$ (see FIG. 17), and which, in the process of inserting and mounting the recovery container 130 into the container receiver 21*a*, is engaged with the recovery container 130 to be retracted from the restricting position $P_1$ to the restriction cancelling position $P_2$ (see FIG. 18); and a restricted member 250 which is disposed so as to be projected to the inside of the opening/closing door 220, which, when the restricting member 231 is located at the restricting position $P_1$, is placed at a position where the member interferes with the restricting member 231, and which, when the restricting member 231 is located at the restriction cancelling position $P_2$, is placed at a position where the member does not interfere with the restricting member 231.

<Restricting Member>

Figure 15:
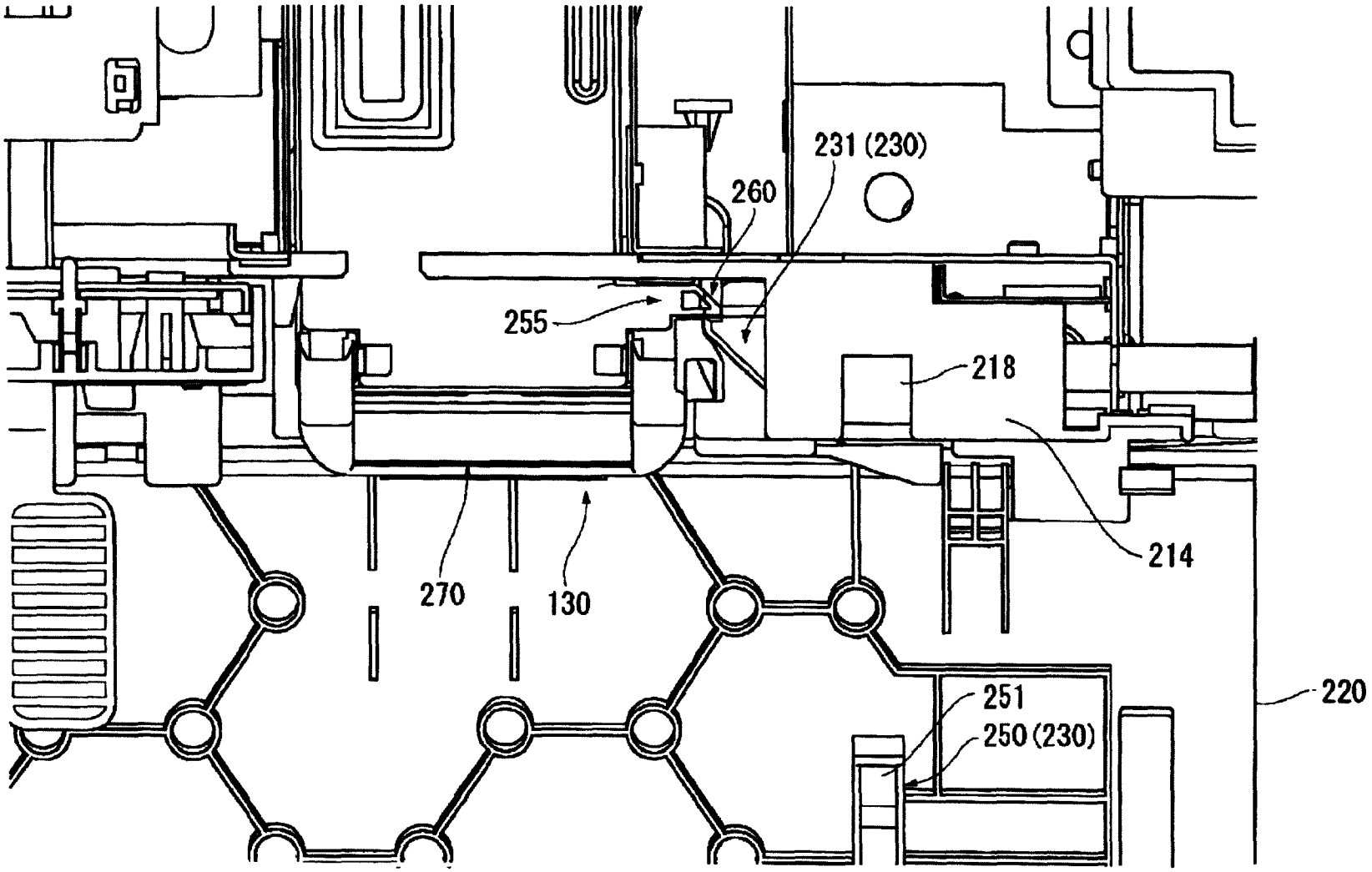
FIG. 15 is a plan view of FIG. 14.
Figure 16A:
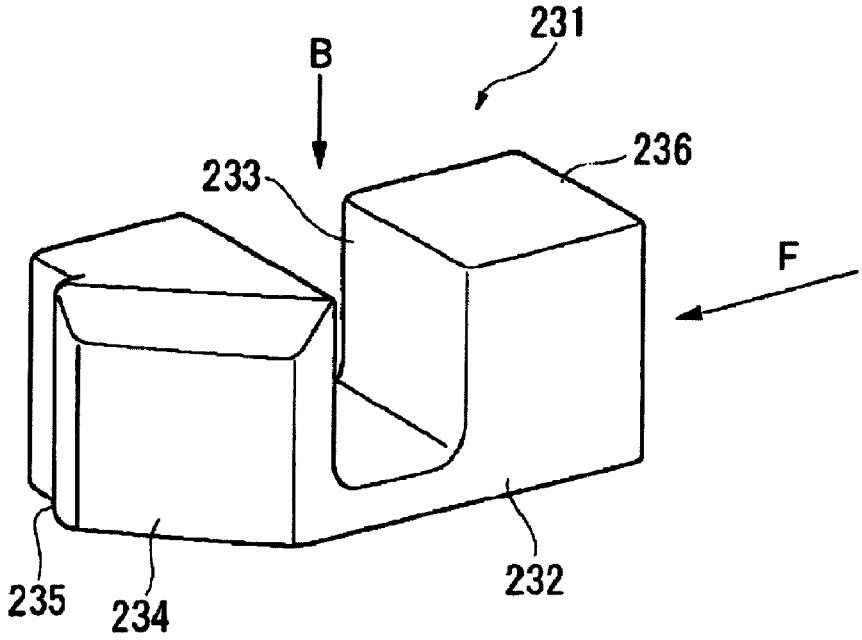
FIG. 16A is a perspective view of a restricting member of an opening/closing restricting mechanism used in Embodiment 1.
Figure 16B:
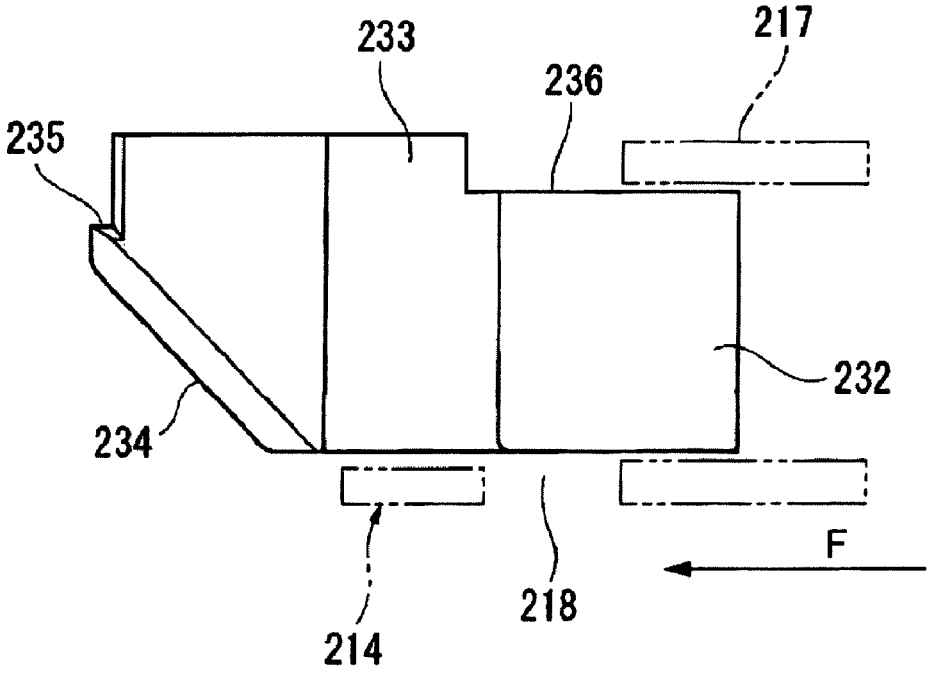
FIG. 16B is a plan view of FIG. 16A.

As shown in FIGS. 15, 16A, and 16B, the restricting member 231 has a substantially rectangular parallelepiped block body 232 which is made of a synthetic resin, and which extends a direction (in this example, corresponding to a horizontal direction along the surface of the front frame 211) intersecting with the inserting/extracting direction (in this example, corresponding to the longitudinal direction of the recovery container 130) of the recovery container 130. A recess 233 which passes through in the inserting/extracting direction of the recovery container 130, and which has a substantially U-like section shape is formed in a middle portion of the block body 232. An inclined portion 234 which is inclined so as to extend in the inserting direction of the recovery container 130 is formed on the side of the container insertion port 212 across the recess 233 of the block body 232, a retaining claw 235 is formed in a portion of the inclined portion 234 which is projected toward the container insertion port 212, and a cutaway recess 236 is formed on the opposite back surface across the recess 233 of the block body 232.

Figure 17:
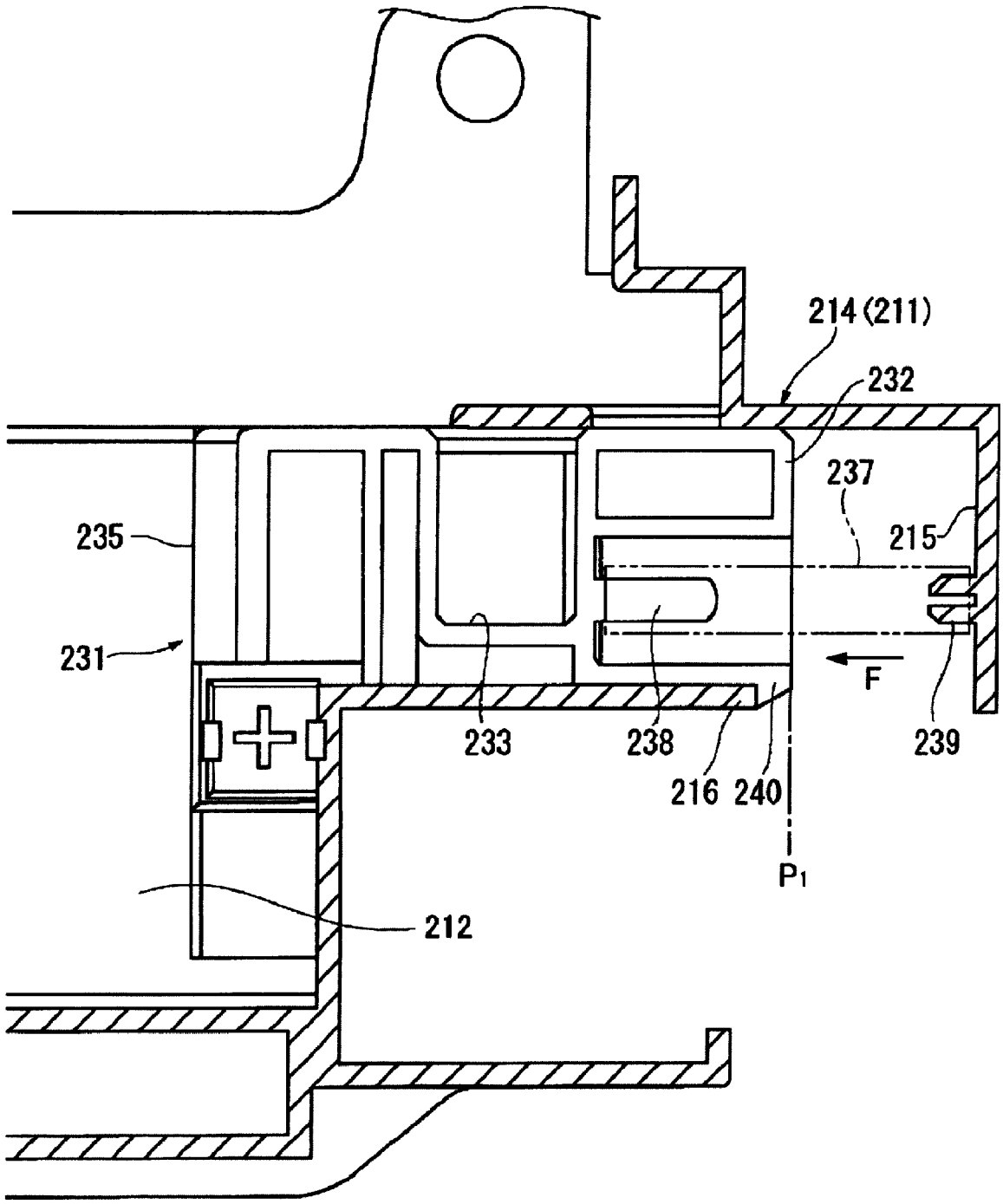
FIG. 17 is a diagram showing a mounting structure in the case where the restricting member of the opening/closing restricting mechanism used in Embodiment 1 is located at a restricted position.
Figure 18:
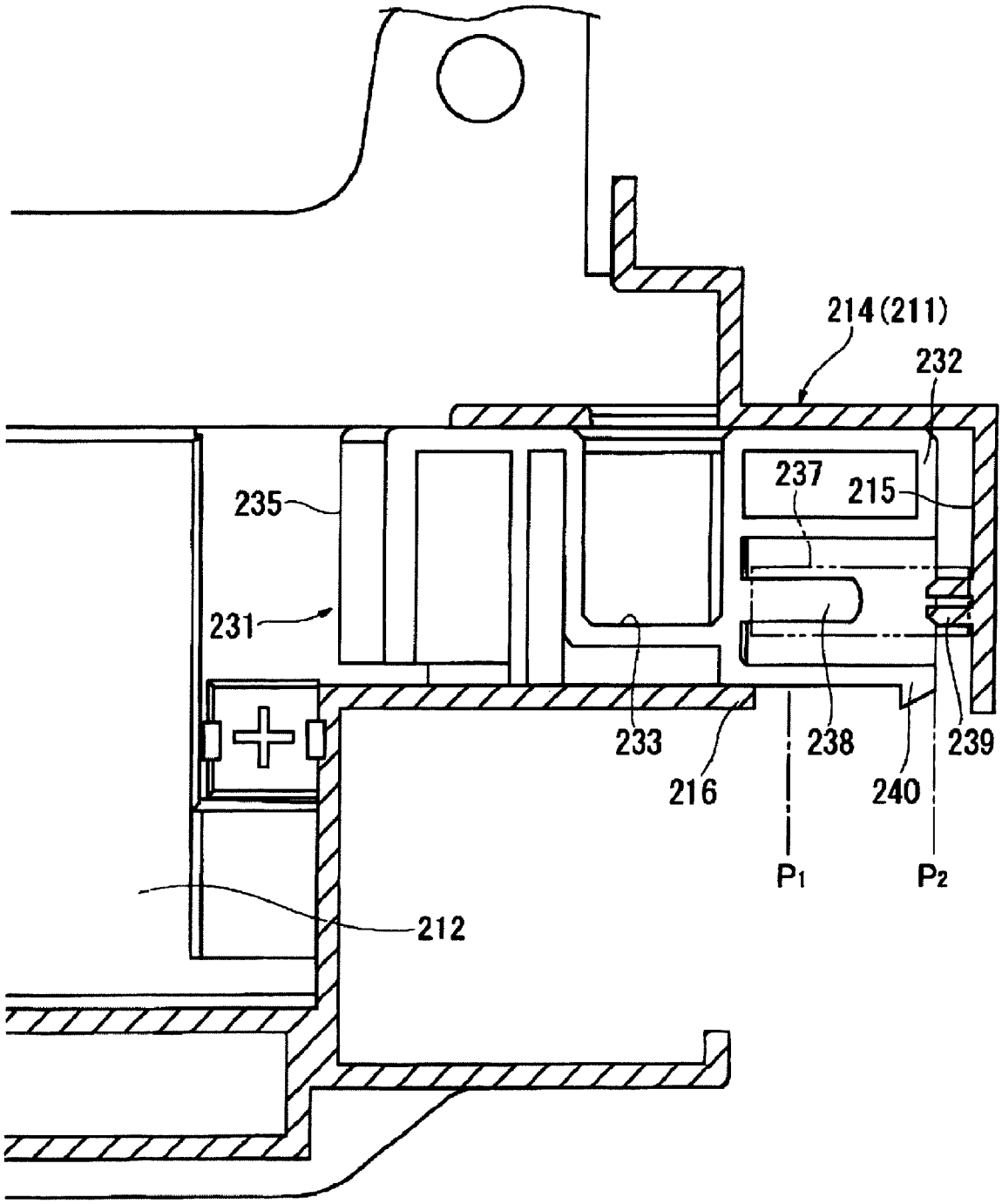
FIG. 18 is a diagram showing the mounting structure in the case where the restricting member of the opening/closing restricting mechanism used in Embodiment 1 is located at a restriction cancelling position.

In the embodiment, as shown in FIGS. 15, 16, 17, and 18, the restricting member 231 is movably held in an embraced manner by a holding frame 214 which is disposed in the front frame 211 of the apparatus chassis 21, and an urging spring 237 is interposed between the block body 232 and a vertical wall 215 of the holding frame 214 on the side remote from the container insertion port 212, so that the block body 232 is urged by the urging force F toward the container insertion port 212. In FIGS. 17 and 18, the reference numerals 238, 239 respectively denote a pin and hook claw which are used for holding the urging spring 237.

As shown in FIG. 17, the restricting member 231 further has a stopper claw 240 on a lower edge portion of the block body 232 on the side remote from the container insertion port 212. The stopper claw 240 is butted against a part 216 of the holding frame 214 by the urging force F of the urging spring 237, so that the restricting member is located at the restricting position $P_1$.

As shown in FIG. 18, the restricting member 231 is moved by the engagement with the recovery container 130 toward the restriction cancelling position $P_2$ against the urging force of the urging spring 237 to be located at the restriction cancelling position $P_2$. A part 217 (see FIG. 16B) of the holding frame 214 is placed in the cutaway recess 236 of the restricting member 231, whereby the moving distance of the restricting member 231 from the restricting position $P_1$ to the restriction cancelling position $P_2$ is ensured, and the restricting member is prevented from being dismounted from the holding frame 214.

<Restricted Member>

In the embodiment, the restricted member 250 is configured by a boss 251 which is projected toward the inside of the opening/closing door 220. The boss 251 may be configured integrally with the opening/closing door 220, or by fixing another member separated from the opening/closing door 220.

An insertion port 218 into which the boss 251 can be inserted is opened in the holding frame 214 corresponding to the boss 251. When the restricting member 231 is located at the restricting position $P_1$, the recess 233 of the restricting member 231 is located at a position displaced from the insertion port 218 of the holding frame 214, and, when the restricting member 231 is located at the restriction cancelling position $P_2$, the recess 233 of the restricting member 231 is located at a position corresponding to the insertion port 218 of the holding frame 214.

<Operating Member>

In the embodiment, the opening/closing restricting mechanism 230 includes an operating member 255 which is on the side of the recovery container 130, and which is engaged with the restricting member 231 to move the restricting member 231 from the restricting position $P_1$ to the restriction cancelling position $P_2$.

Figure 19:
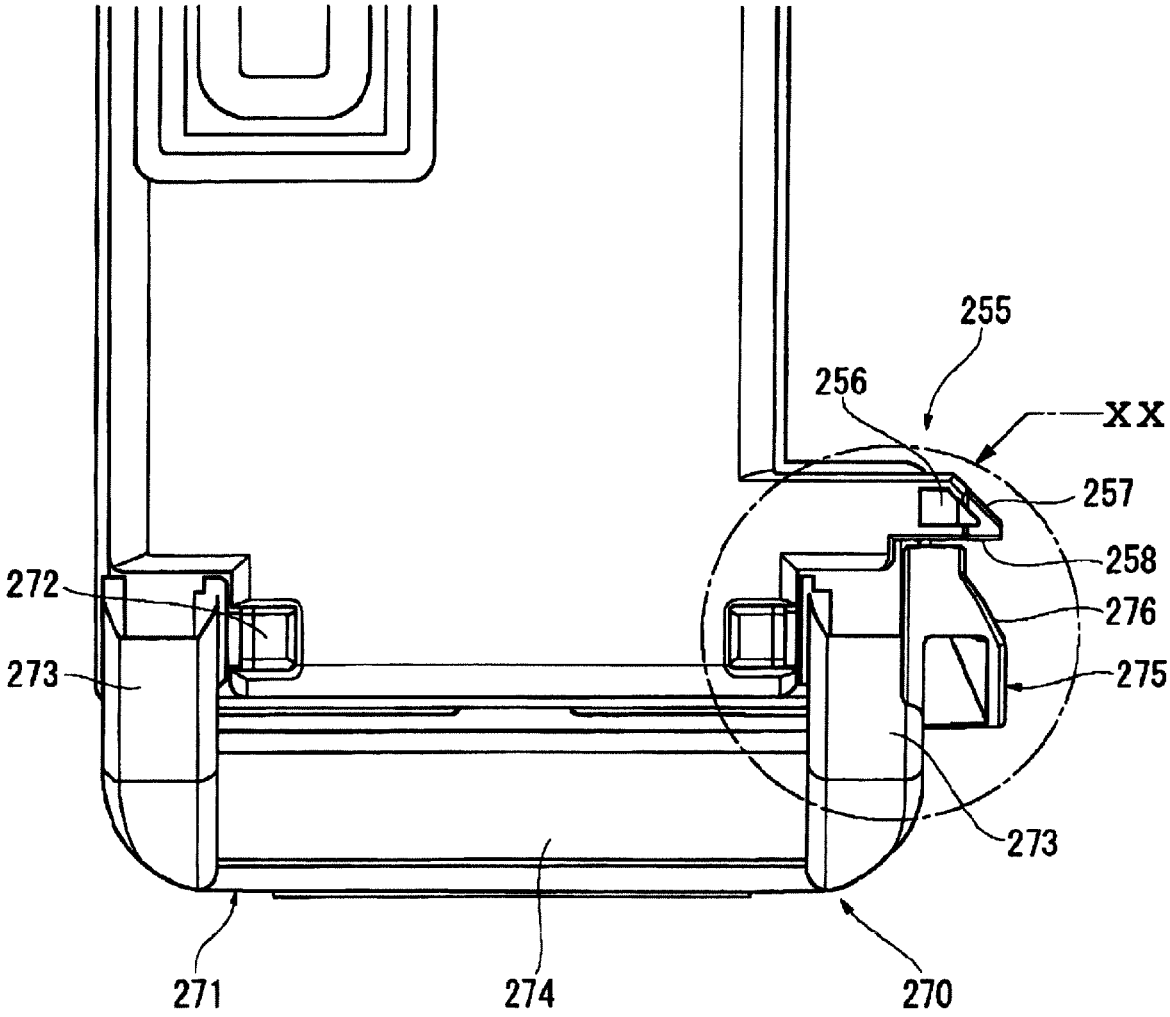
FIG. 19 is a plan view showing main portions of the recovery container used in Embodiment 1.
Figure 20:
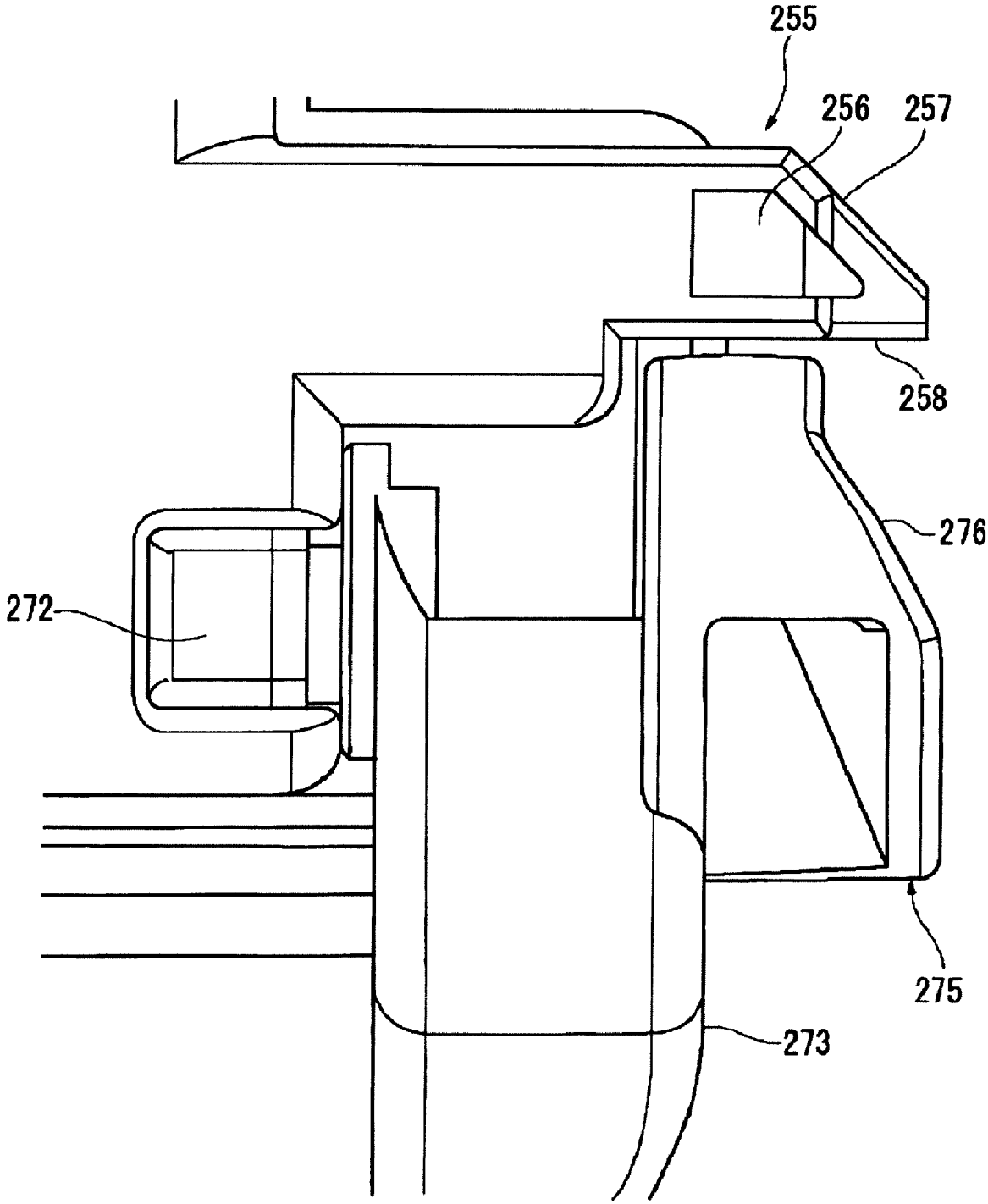
FIG. 20 is a view showing in detail portion XX in FIG. 19.

As shown in FIGS. 19 and 20, the operating member 255 has a projecting piece 256 which, in the process of inserting and mounting the recovery container 130 into the container receiver 21*a*, is butted against the inclined portion 234 of the restricting member 231. In the projecting piece 256, a guidance inclined portion 257 corresponding to the inclined portion 234 of the restricting member 231 is formed, and an engaging portion 258 which, when the guidance inclined portion 257 overrides the inclined portion 234 of the restricting member 231, is engaged with the retaining claw 235 of the restricting member 231 is formed in an projecting end of the projecting piece 256.

—Locking Mechanism—

Figure 26:
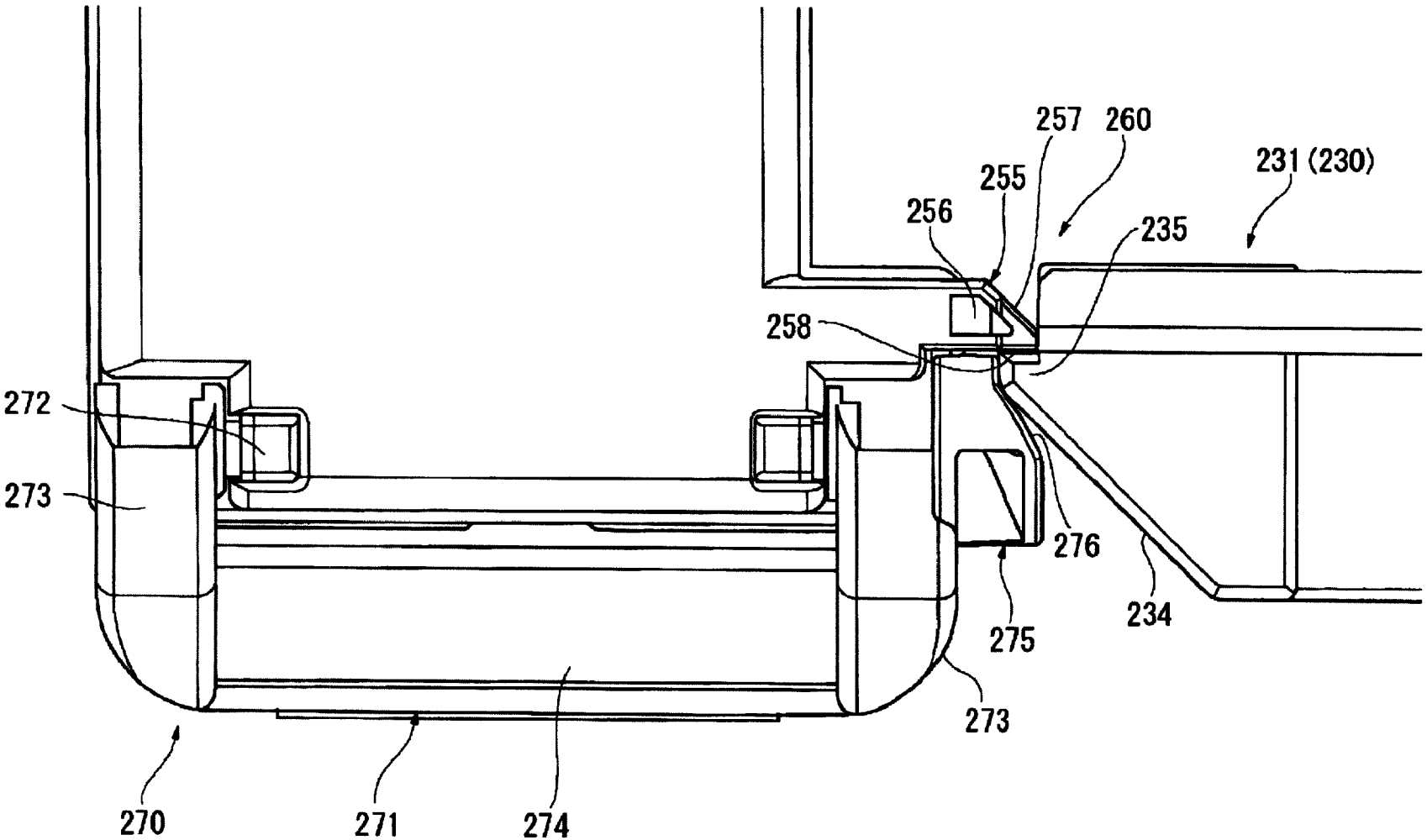
FIG. 26 is a view enlargedly showing a constrained state by the constraining mechanism of FIG. 25B.

In the embodiment, as shown in FIGS. 16, 19, and 26, the locking mechanism 260 is configured by using the components of the opening/closing restricting mechanism 230, and has the retaining claw 235 (corresponding to the constraining portion) of the restricting member 231 which is urged by the urging spring 237, and the engaging portion 258 (corresponding to the constrained portion) of the operating member 255 which is engaged with the retaining claw 235, and which constrains the recovery container 130 mounted on the container receiver 21*a*.

Although, in the embodiment, the locking mechanism 260 uses the components of the opening/closing restricting mechanism 230, the locking mechanism is not restricted to this. Alternatively, the locking mechanism may use a part of the components of the opening/closing restricting mechanism 230, or may be disposed separately from the opening/closing restricting mechanism 230.

—Lock Cancelling Mechanism—

In the embodiment, as shown in FIGS. 19, 20, and 25 to 28, in the lock cancelling mechanism 270, a handle 271 which is swingable in the drawing-out direction is disposed in an end portion in the dismounting direction of the recovery container 130 mounted on the container receiver 21*a* is disposed. When the handle 271 is swung in the drawing-out direction, the constrained state by the locking mechanism 260 is cancelled by a swing piece 275 which is swung together with the handle 271.

The handle 271 has swing shafts 272 which are above the end portion in the dismounting direction of the recovery container 130. A plate-like operating portion 274 is bridged between swing free ends of a pair of swing arms 273 which are swung about the swing shafts 272.

By contrast, the swing piece 275 is disposed in the vicinity of the swing shaft 272 of one of the swing arms 273, and swung together with the swinging operation of the swing arms 273, and has a curved inclined portion 276 which is contacted with the retaining claw 235 of the locking mechanism 260 to move the retaining claw 235 at the degree by which the retaining claw 235 is disengaged from the engaging portion 258.

—Driving Transmission of Powder Recovery Device—

(1) When Recovery Container is Mounted

Figure 21:
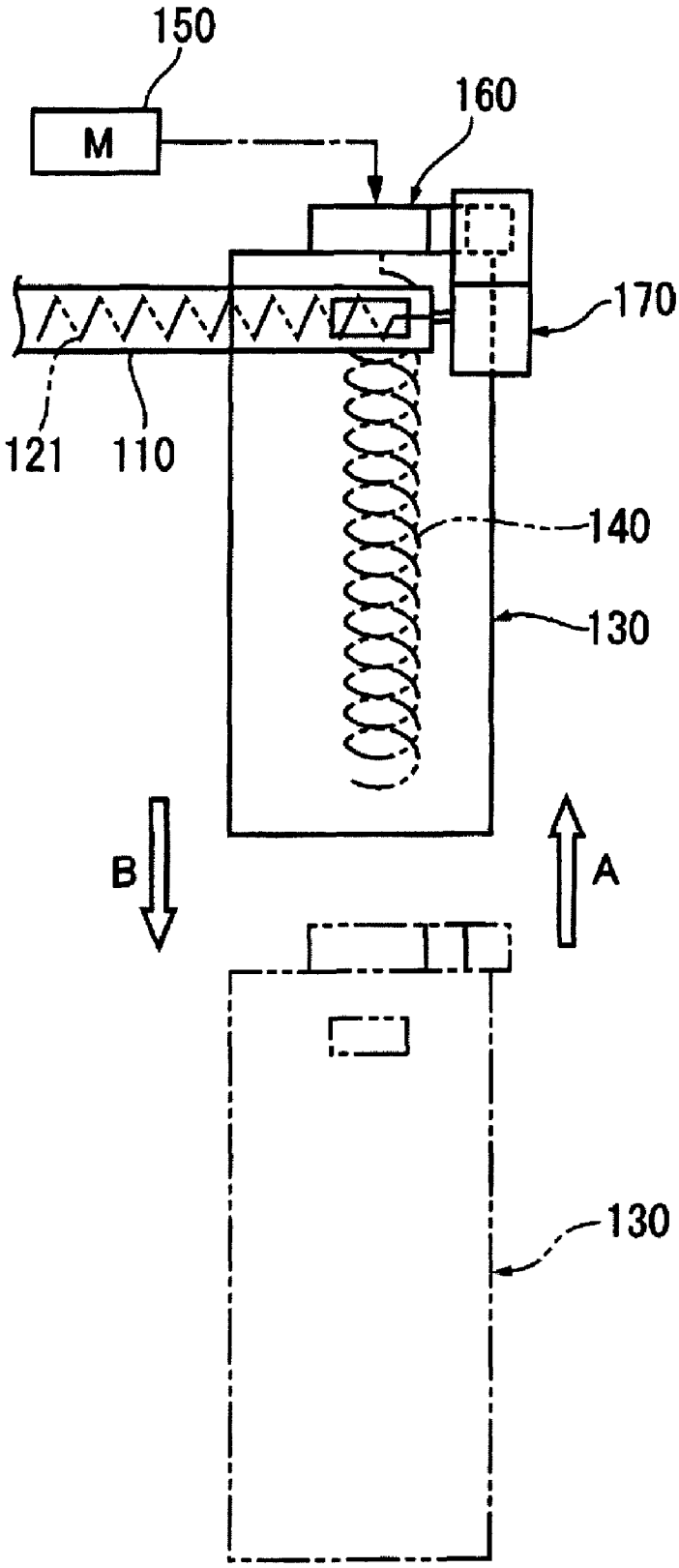
FIG. 21 is a diagram showing operation states in mounting and dismounting of the recovery container of the powder recovery device (powder storage device) of Embodiment 1.

As shown in FIG. 21, when the recovery container 130 is mounted on the container receiver 21*a* in the direction of arrow A, the driving force exerted by the driving motor 150 is transmitted to the conveying member 140 of the recovery container 130 through the recovery driving mechanism 160. On the other hand, the driving force exerted by the driving motor 150 is transmitted to the conveying member 121 of the conveying pipe 110 through the recovery driving mechanism 160 and the conveyance driving mechanism 170.

(2) When Recovery Container is Dismounted

As shown in FIG. 21, when the recovery container 130 is drawn out and dismounted from the container receiver 21*a* in the direction of arrow B, the conveyance driving mechanism 170 of the conveying pipe 110 is not engaged with the recovery driving mechanism 160 on the side of the recovery container 130, and hence the driving force exerted by the driving motor 150 is not transmitted to the conveyance driving mechanism 170 inside the conveying pipe 110.

At this time, as shown in FIG. 3, an opening/closing door 21*b* is disposed on the side face of the apparatus chassis 21. When the opening/closing door 21*b* is opened, the user can manually operate the conveyance driving mechanism 170 of the conveying pipe 110 disposed on the back face side of the apparatus chassis 21, by using the opening of the opening/closing door 21*b*.

In this case, if it can be checked that, when the conveyance driving mechanism 170 is manually operated, the conveyance driving mechanism 170 is moved, it is known that powder clogging does not occur in the conveying pipe 110.

Conversely, if it can be checked that, even when the conveyance driving mechanism 170 is manually operated, the conveyance driving mechanism 170 is not moved, there is a possibility that powder clogging occurs in the conveying pipe 110.

—Restriction of Opening/Closing of Opening/Closing Door of Powder Recovery Device—

(1) When Recovery Container is Not Mounted

Figure 22:
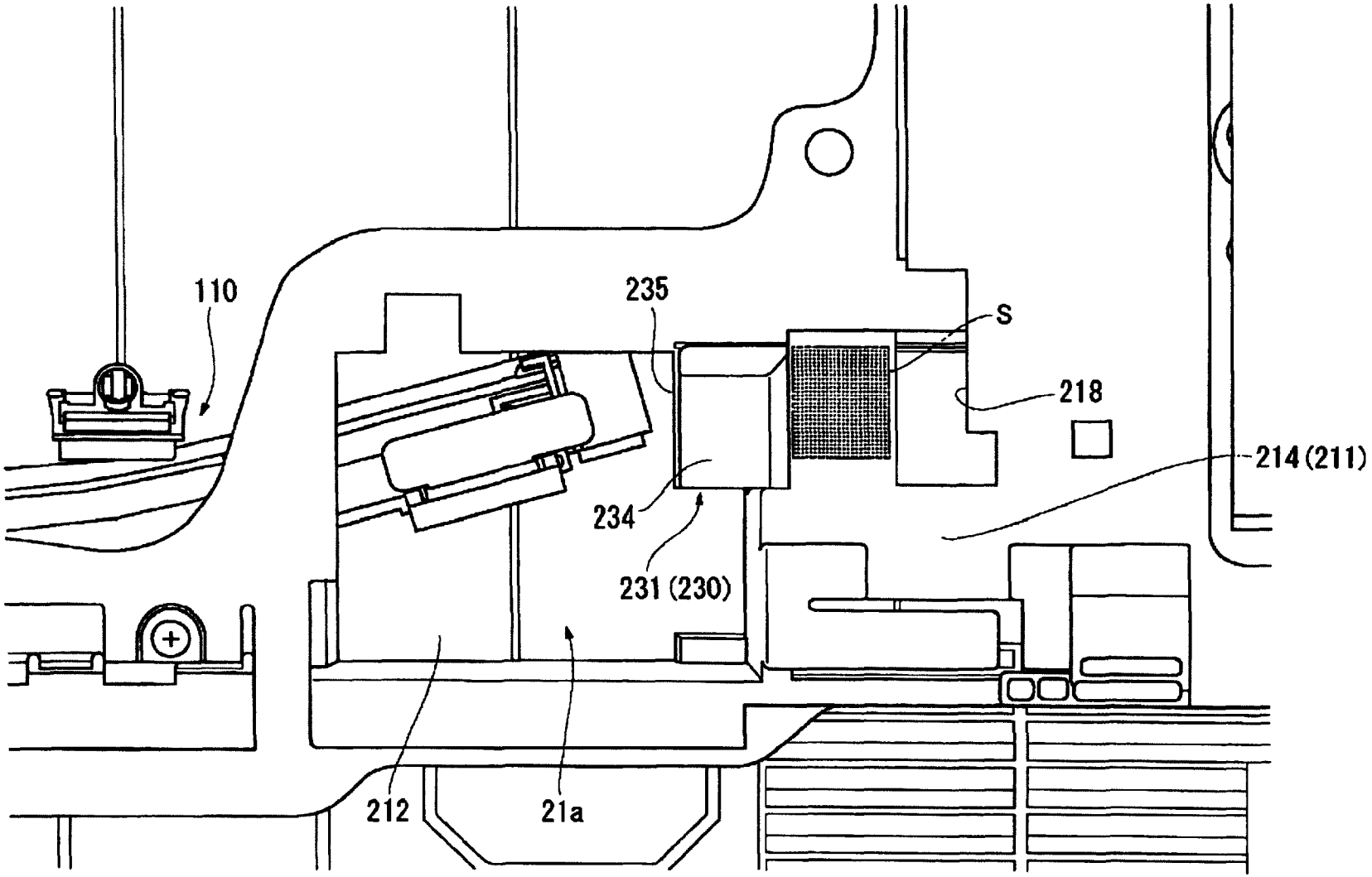
FIG. 22 is a front view schematically showing a state of the powder recovery device to which the recovery container in Embodiment 1 is not mounted.

FIG. 22 shows an example of the operation of the opening/closing restricting mechanism when the recovery container is not mounted.

Referring to the figure, the restricting member 231 of the opening/closing restricting mechanism 230 is urged by the urging spring 237 to be located at the restricting position $P_1$ (see FIG. 17).

In this state, the recess 233 (indicated by S in the figure) of the restricting member 231 is shifted to a position displaced from the insertion port 218 of the holding frame 214. In the case where it is tried to close the opening/closing door 220 while the recovery container 130 is not mounted on the container receiver 21*a*, when the restricted member 250 of the opening/closing door 220 is inserted into the insertion port 218 of the holding frame 214, therefore, the boss 251 functioning as the restricted member 250 is butted against the block body 232 of the restricting member 231, and the closing operation of the opening/closing door 220 is restricted.

Consequently, the opening/closing door 220 is not closed in the situation where the recovery container 130 is not mounted on the container receiver 21*a*, and hence there is no possibility that the image forming process is started while the recovery container 130 is not mounted.

In the case where the recovery container 130 is incompletely mounted on the container receiver 21*a*, the constraint by the locking mechanism 260 is not performed, and hence the recovery container 130 is pushed back in the dismounting direction by the inclined portion 234 of the restricting member 231 which is urged by, for example, the urging spring 237. In this state, even when it is tried to close the opening/closing door 220, the recovery container 130 which is pushed out from the container receiver 21*a* blocks the closing operation, and hence the opening/closing door 220 is not closed.

(2) When Recovery Container is Mounted

Figure 23:
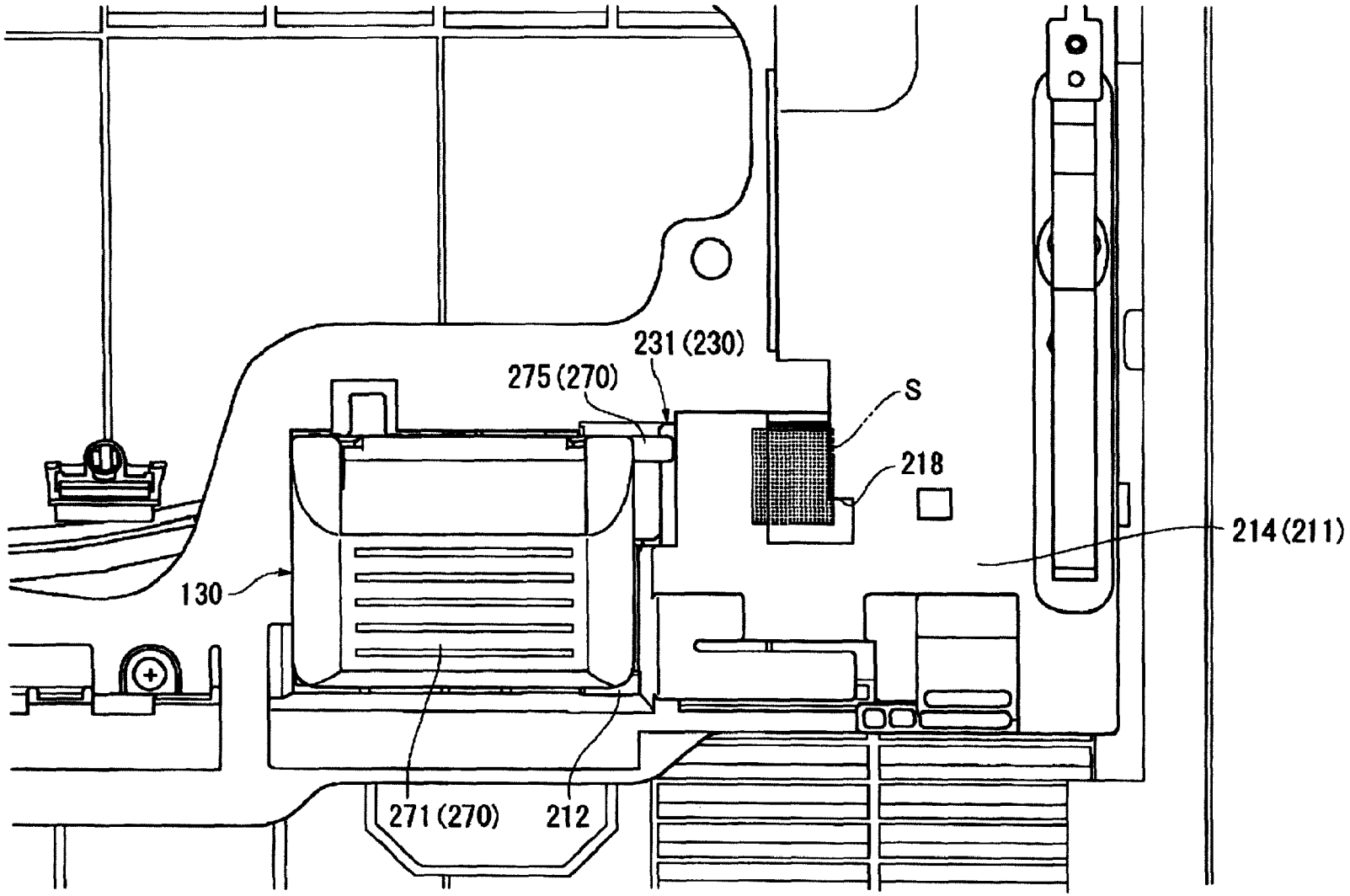
FIG. 23 is a front view schematically showing a state of the powder recovery device to which the recovery container in Embodiment 1 is mounted.

FIG. 23 shows an example of the operation of the opening/closing restricting mechanism when the recovery container is mounted.

First, the operation process of inserting and mounting the recovery container 130 on the container receiver 21*a* will be described with reference to FIGS. 24A and 24B.

Figure 24A:
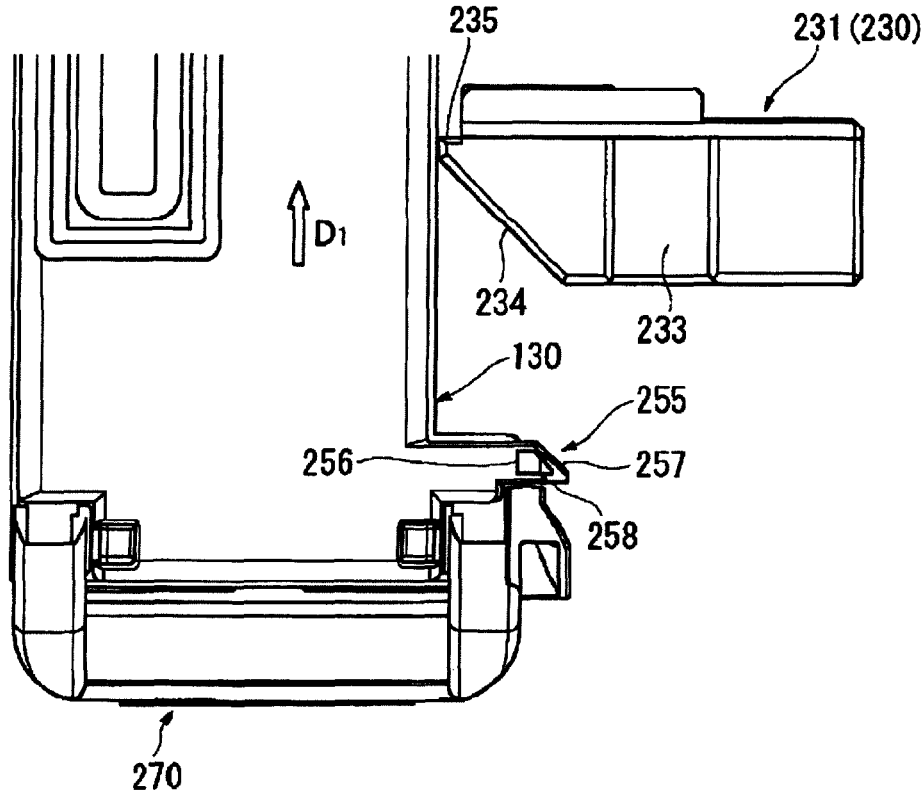
FIGS. 24A and 24B are diagrams showing an operation process in the case where the recovery container is inserted and mounted to the container receiver in Embodiment 1.
Figure 24B:
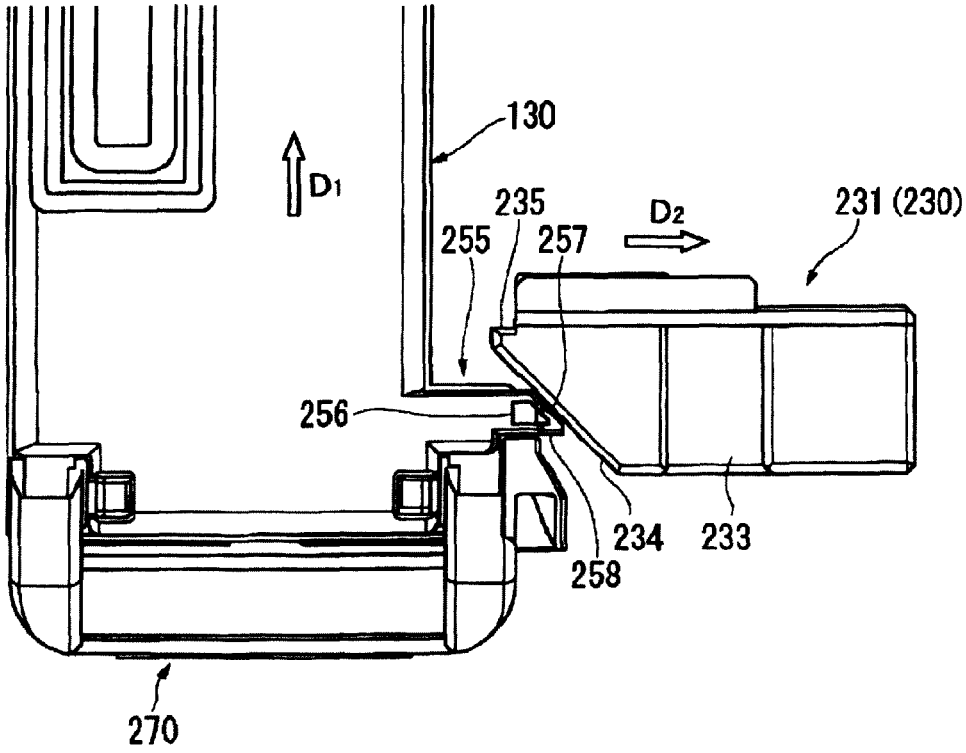

As shown in FIGS. 24A and 24B, when the recovery container 130 is inserted in the direction of arrow $D_1$ through the container insertion port 212 of the container receiver 21*a*, the restricting member 231 of the opening/closing restricting mechanism 230 is moved while being contacted with one side face of the recovery container 130 intersecting in the longitudinal direction, because the restricting member 231 is urged by the urging spring 237. As shown in FIG. 24B, the inclined portion 234 of the restricting member 231 is butted against the guidance inclined portion 257 of the operating member 255 on the side of the recovery container 130. In accordance with the engagement between the two portions, the restricting member 231 is pressed in the direction of arrow $D_2$ against the urging force of the urging spring 237, and moved from the restricting position $P_1$ toward the restriction cancelling position $P_2$.

Figure 25A:
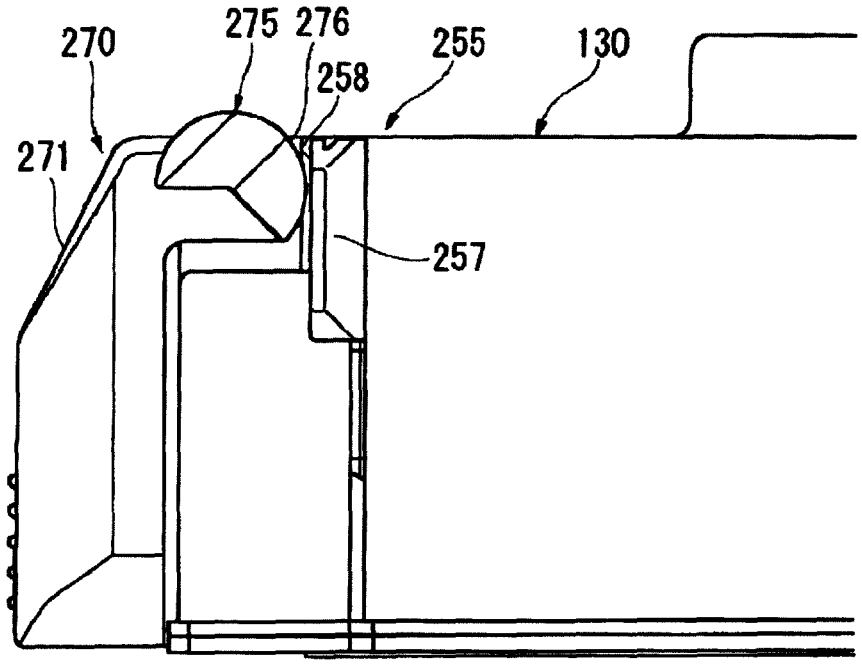
FIG. 25A is a side view of main portions of the recovery container in the case where the recovery container is mounted on the container receiver and constrained by a constraining mechanism, as looking from the lateral side.
Figure 25B:
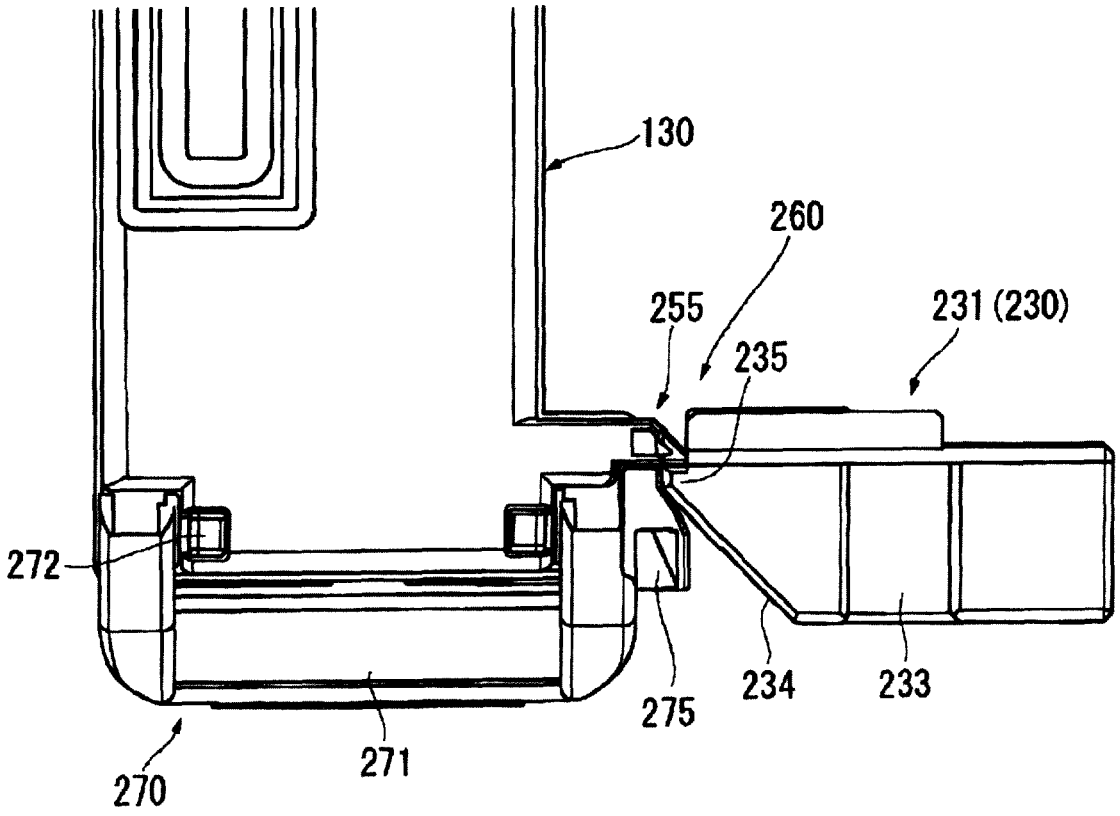
FIG. 25B is a plan view of the main portions.

When the guidance inclined portion 257 of the operating member 255 then overrides the inclined portion 234 of the restricting member 231, the engaging portion 258 of the operating member 255 is engaged with the retaining claw 235 of the restricting member 231 as shown in FIGS. 25 and 26. In this state, the recovery container 130 is mounted on the container receiver 21*a* in a constrained state by the locking mechanism 260.

When the recovery container 130 is mounted on the container receiver 21*a* as described above, the restricting member 231 is located at the restriction cancelling position $P_2$ (see FIG. 18).

In this state, the recess 233 (indicated by S in the figure) of the restricting member 231 is located at the position corresponding to the insertion port 218 of the holding frame 214. In the case where it is tried to close the opening/closing door 220, when the restricted member 250 of the opening/closing door 220 is inserted into the insertion port 218 of the holding frame 214, therefore, the boss 251 functioning as the restricted member 250 is accommodated into the recess 233 of the restricting member 231, and the closing operation of the opening/closing door 220 is allowed.

In the situation where the recovery container 130 is mounted on the container receiver 21*a*, therefore, the opening/closing door 220 is closed, and hence the image forming process is started in the state where the recovery container 130 is mounted.

—Operation of Dismounting Recovery Container—

In the case where the recovery container 130 is filled with recovered powder, it is necessary to dismount the recovery container 130 from the container receiver 21*a*, and replace the container with a new recovery container 130.

At this time, after the opening/closing door 220 is opened, the lock cancelling mechanism 270 of the recovery container 130 is operated, whereby the constrained state by the locking mechanism 260 is cancelled.

Figure 27A:
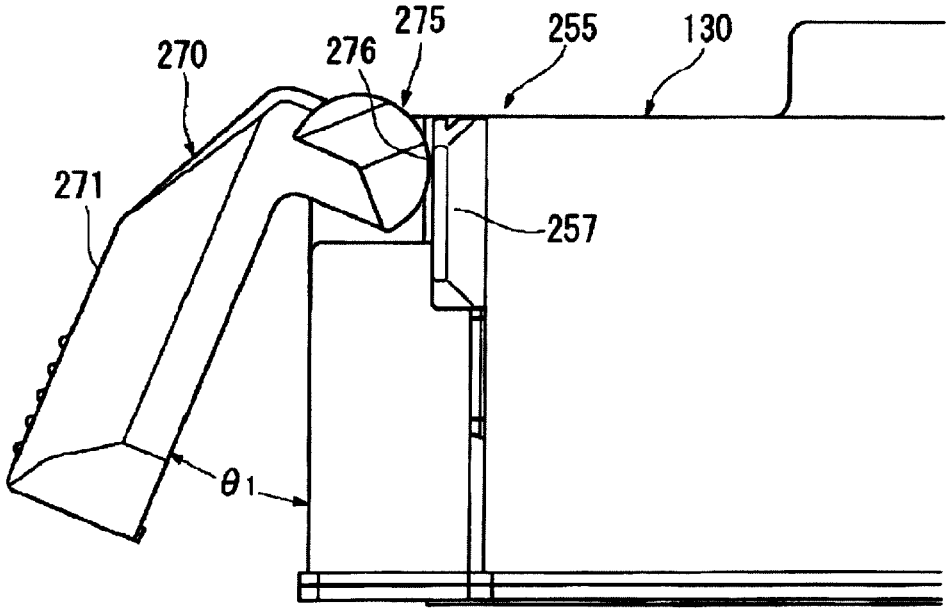
FIG. 27A is a side view of main portions of the recovery container in an initial process of dismounting the storage container from the container receiver, as looking from the lateral side.
Figure 27B:
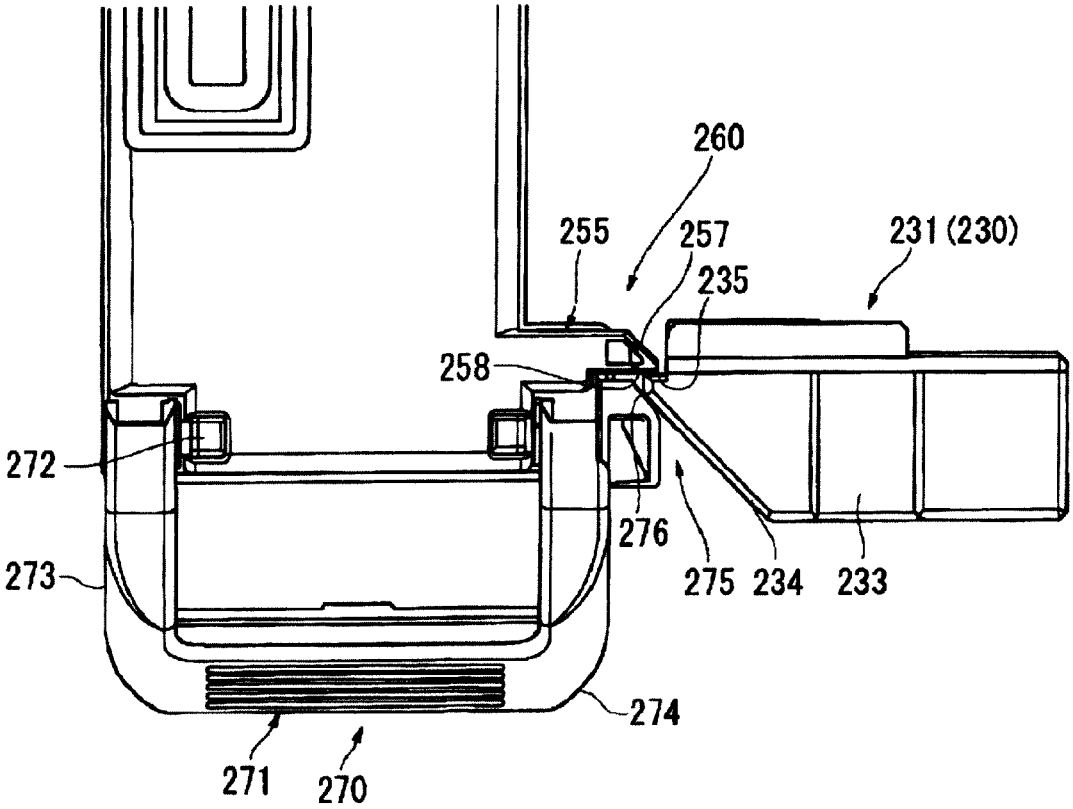
FIG. 27B is a plan view of the main portions.

Assuming that, as shown in FIGS. 25 and 26, the recovery container 130 is mounted on the container receiver 21*a* in the state where the recovery container is constrained by the locking mechanism 260, when the handle 271 of the lock cancelling mechanism 270 is swung by a predetermined angle $\theta_1$ (for example, 30°) from a vertical posture in the drawing-out direction, the swing piece 275 of the lock cancelling mechanism 270 is swung as shown in FIG. 27B, and the curved inclined portion 276 of the swing piece 275 presses back the retaining claw 235 of the restricting member 231 against the urging force of the urging spring 237.

Figure 28A:
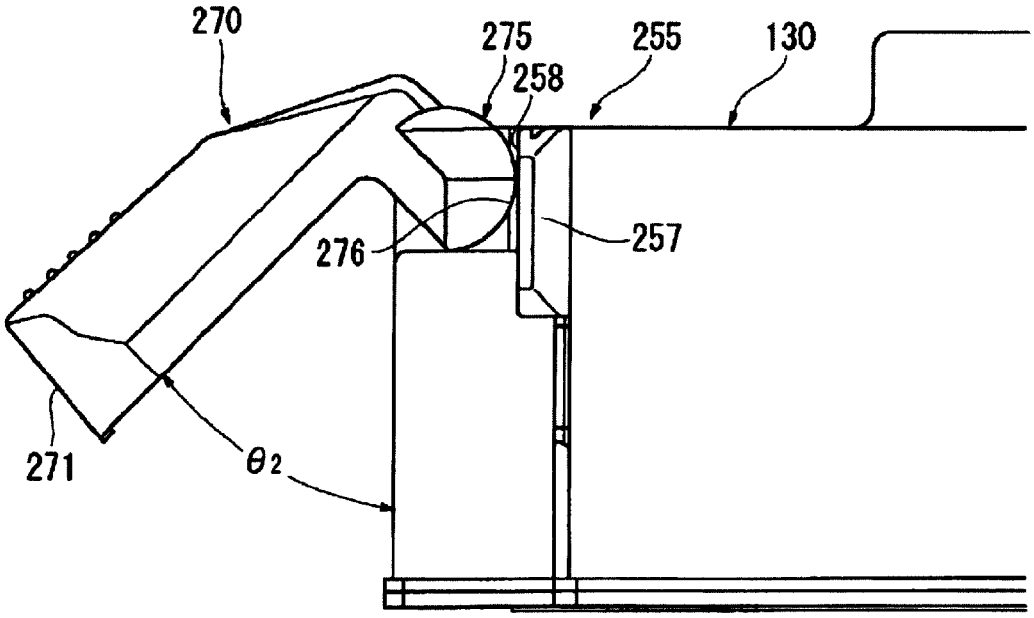
FIG. 28A is a side view of main portions of the recovery container in the case where the constrained state by the constraining mechanism is cancelled in a process of dismounting the storage container from the container receiver, as looking from the lateral side, and FIG. 2BB is a plan view of the main portions.
Figure 28B:
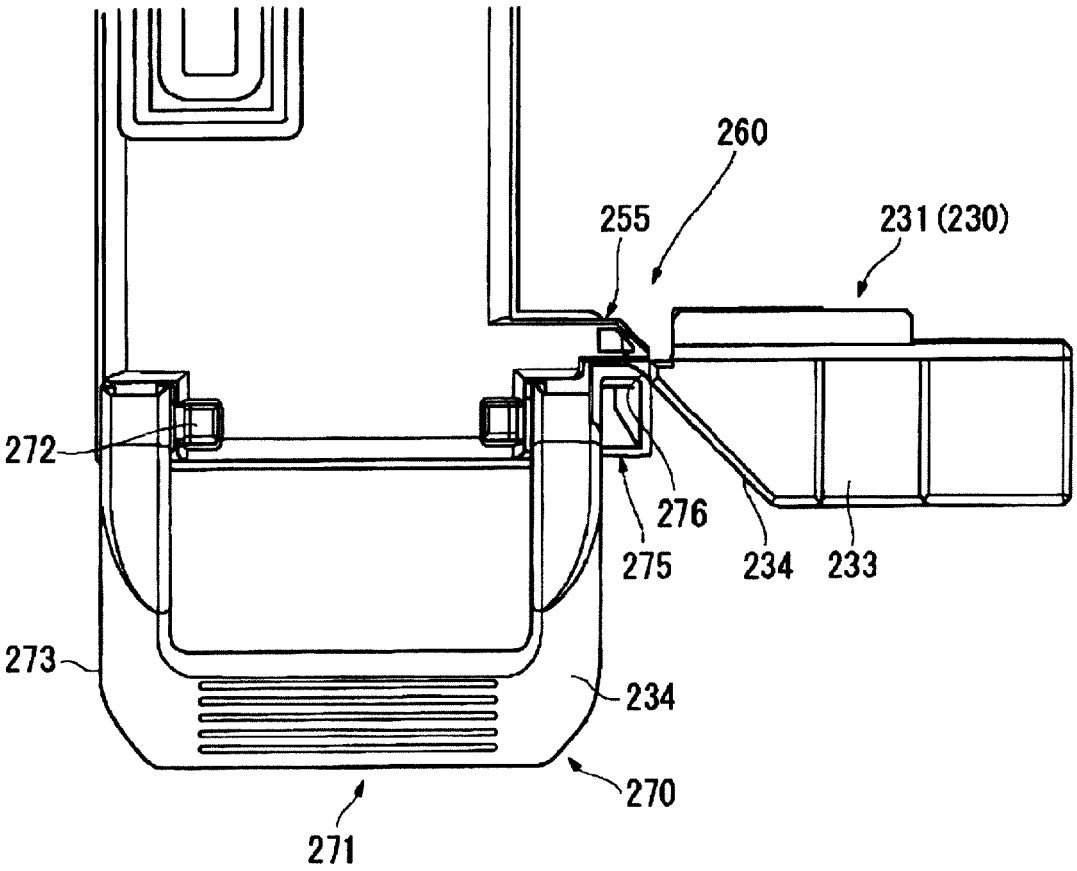

As shown in FIG. 28A, thereafter, the handle 271 of the lock cancelling mechanism 270 is further swung to be drawn out by a predetermined angle $\theta_2$ (for example, 45°) from the vertical posture. As shown in FIG. 28B, then, the swing piece 275 of the lock cancelling mechanism 270 is further swung, the curved inclined portion 276 of the swing piece 275 further presses back the retaining claw 235 of the restricting member 231 against the urging force of the urging spring 237, and the engaged state of the retaining claw 235 of the restricting member 231 with respect to the engaging portion 258 of the operating member 255 is cancelled.

In this state, the constrained state of the recovery container 130 by the locking mechanism 260 is cancelled, and the user is allowed to pull the recovery container 130 while griping the handle 271 of the lock cancelling mechanism 270, so that the recovery container 130 is dismounted from the container receiver 21*a*.

Embodiment 2

Figure 29:
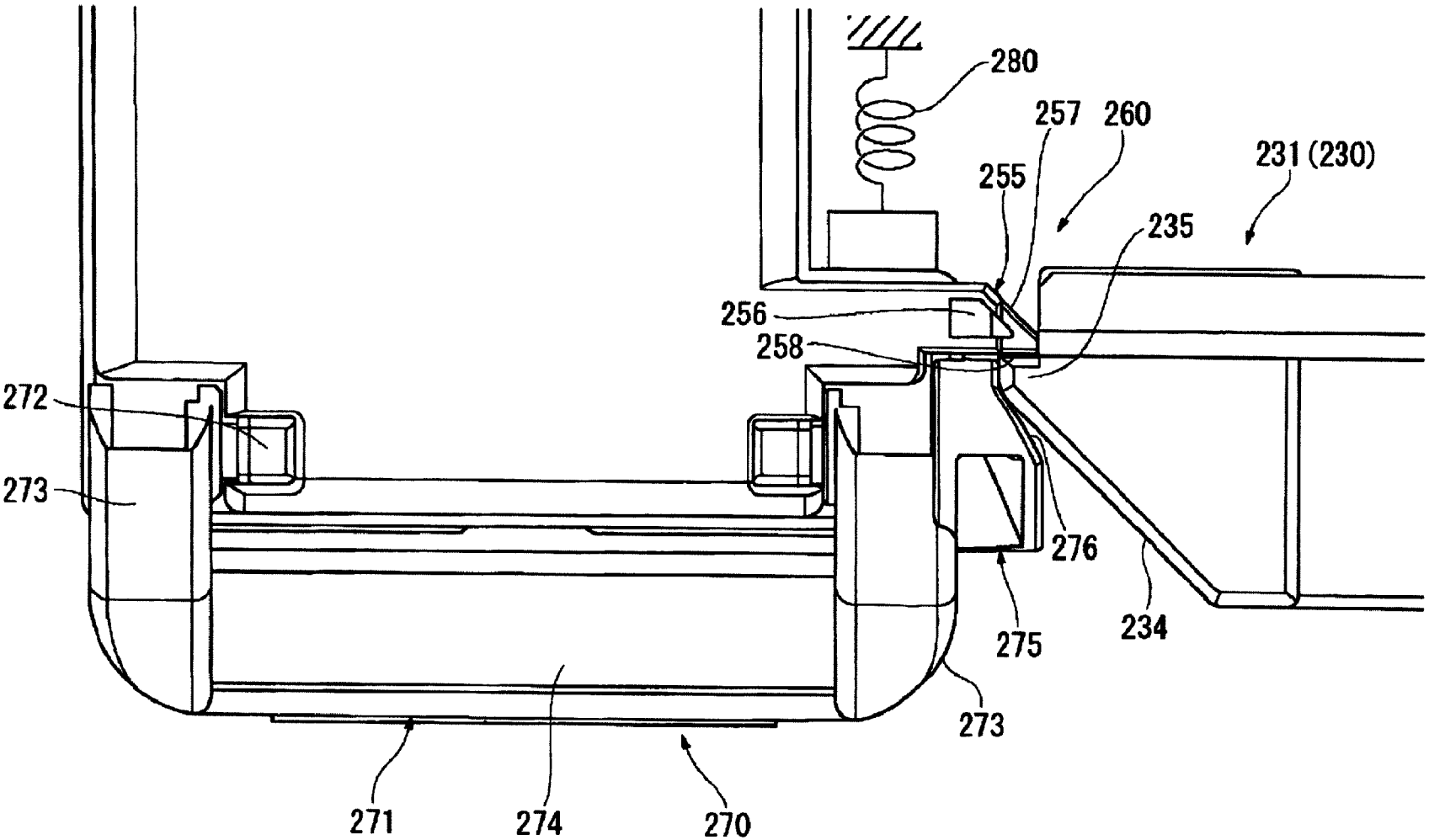
FIG. 29 is a diagram schematically showing main portions of a powder storage device of Embodiment 2.

FIG. 29 is a diagram showing main portions of Embodiment 2 of the image forming apparatus to which the invention is applied.

Referring to the figure, the image forming apparatus is basically configured in a substantially similar manner as Embodiment 1. Unlike Embodiment 1, an urging spring 280 which, when the recovery container 130 is mounted on the container receiver 21*a*, urges the recovery container 130 in the dismounting direction is additionally disposed.

For example, a spring element disposed in the shutter of the recovery container 130 may be used also as the urging spring 280, or the urging spring may be disposed separately from the spring element of the shutter.

The components similar to those of Embodiment 1 are denoted by the same reference numerals as those of Embodiment 1, and their detailed description is omitted.

According to the configuration where the urging spring 280 is added, in the case where the recovery container 130 is incompletely mounted on the container receiver 21*a*, the urging spring 280 exerts an effect of pushing out the recovery container 130 in the dismounting direction. Therefore, the recovery container 130 which is incompletely mounted is always pushed out from the container receiver 21*a*, and therefore the fear that the recovery container 130 is incompletely mounted on the container receiver 21*a* is effectively eliminated.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A powder storage device that stores powder to be supplied or recovered powder, the powder storage device comprising:

a container that is extractably mounted on a container receiver, and in which powder to be supplied or recovered powder is stored;

a cover that is movable between an open state and a closed state, the cover uncovers the container receiver in the open state and covers the container receiver in the closed state; and a restricting mechanism that restricts the cover to the closed state, and the restricting mechanism comprising:

a restricting member that is disposed on a side of the container receiver, the restricting member is located at a first position when the container is not mounted on the container receiver, and the restricting member is located at a second position when the container is mounted on the container receiver; and a restricted member that is disposed on a side of the cover, the restricted member interferes with the restricting member so as to restrict the cover to move to the closed state when the restricting member is located in the first position, and the restricted member does not interfere with the restricting member so as to allow the cover to move to the closed state when the restricting member is located in the second position, wherein the restricting member obstructs the container, which is mounted in the container receiver, to be carried out from the container receiver when the restricting member is in the second position, wherein the restricting member is movable along a direction intersecting with an inserting/extracting direction of the container, and the restricting member moves linearly.

2. The powder storage device according to claim 1, wherein the restricting mechanism comprises an operating member that is disposed on a side of the container, that, in a process of inserting and mounting the container into the container receiver, is engaged with the restricting member to move the restricting member located at the first position toward the second position, and that, when the container is mounted on the container receiver, causes the restricting member to be retracted to the second position.

3. The powder storage device according to claim 1, wherein the restricting member is urged toward the first position through an urging member, and, in a process of inserting and mounting the container into the container receiver, retracted to the second position against an urging force exerted by the urging member.

4. The powder storage device according to claim 1, wherein the restricted member has a projection which projects toward the restricting member, and the restricting member has a recess or hole into which, when the restricting member is located at the second position, the projection is fitted, at a portion corresponding to the projection of the restricted member.

5. The powder storage device according to claim 1, wherein the powder storage device further comprises a constraining mechanism that, when the container is mounted on the container receiver, causes the container to be constrained to the container receiver, and the constraining mechanism uses the restricting member of the restricting mechanism, as an element.

6. The powder storage device according to claim 5, wherein the constraining mechanism comprises a constraining portion that is disposed in a part of the restricting member, and a constrained portion (i) that is disposed on a side of the container, and (ii) that, when the container is mounted on the container receiver, is constrained by the constraining portion.

7. The powder storage device according to claim 5, wherein the powder storage device further comprises a constraint cancelling mechanism that is disposed on a side of the container, and that, when the container mounted on the container receiver is to be dismounted, can cancel the constrained state by the constraining mechanism.

8. The powder storage device according to claim 7, wherein, in the constraint cancelling mechanism, a handle which is swingable in a drawing-out direction is disposed in an end portion in the dismounting direction of the container mounted on the container receiver is disposed, and the constrained state by the constraining mechanism is cancelled by a swing piece which, when the handle is swung in the drawing-out direction, is swung together with the handle.

9. The powder storage device according to claim 1, wherein the container comprises an urging member which urges the container in the direction of dismounting from the container receiver.

10. An image forming apparatus comprising:

an image forming device which forms an image by using an image forming material in a form of powder; and the powder storage device according to claim 1, the powder storage device storing powder to be used in the image forming device.

11. The powder storage device according to claim 1, wherein the container comprises an engagement portion that engages with the restricting member when the restricting member is in the second position, so as to obstruct the container to be carried out from the container receiver.

12. The powder storage device according to claim 11, wherein the container comprises an operating member, and the engagement portion is released from the restricting member when the operating member is actuated.

13. A powder storage device that stores powder to be supplied or recovered powder, the powder storage device comprising:

a container that is extractably mounted on a container receiver, and in which powder to be supplied or recovered powder is stored;

a cover that is movable between an open state and a closed state, the cover uncovers the container receiver in the open state and covers the container receiver in the closed state;

a restricting mechanism that restricts the cover to the closed state, and the restricting mechanism comprising:

a restricting member that is disposed on a side of the container receiver, the restricting member is located at a first position when the container is not mounted on the container receiver, and the restricting member is located at a second position when the container is mounted on the container receiver; and a restricted member that is disposed on a side of the cover, the restricted member interferes with the restricting member so as to restrict the cover to move to the closed state when the restricting member is located in the first position, and the restricted member does not interfere with the restricting member so as to allow the cover to move to the closed state when the restricting member is located in the second position, wherein the restricting member obstructs the container, which is mounted in the container receiver, to be carried out from the container receiver when the restricting member is in the second position;

a constraining mechanism that, when the container is mounted on the container receiver, causes the container to be constrained to the container receiver; and a constraint cancelling mechanism that is disposed on a side of the container, and that, when the container mounted on the container receiver is to be dismounted, can cancel the constrained state by the constraining mechanism, and the constraint cancelling mechanism has a handle which is disposed at the container and is swingable, and the constrained state by the constraining mechanism is cancelled by the handle when the handle is swung.

* * * * *